US010889422B2

(12) United States Patent
Jasso

(10) Patent No.: US 10,889,422 B2
(45) Date of Patent: Jan. 12, 2021

(54) RESEALABLE PACKAGE AND ASSOCIATED MATERIALS, METHODS AND SYSTEMS FOR ITS MANUFACTURE

(71) Applicant: Frito-Lay North America, Inc., Plano, TX (US)

(72) Inventor: Mauricio Jasso, General Escobedo (MX)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 15/804,833

(22) Filed: Nov. 6, 2017

(65) Prior Publication Data

US 2019/0135515 A1 May 9, 2019

(51) Int. Cl.

| | |
|---|---|
| ***B65D 75/58*** | (2006.01) |
| ***B65D 65/14*** | (2006.01) |
| ***B65D 75/12*** | (2006.01) |
| ***B65D 75/26*** | (2006.01) |
| ***B65B 9/20*** | (2012.01) |

(Continued)

(52) U.S. Cl.

CPC ..... *B65D 75/5855* (2013.01); *B65B 9/20* (2013.01); *B65B 51/02* (2013.01); *B65B 61/28* (2013.01); *B65D 65/14* (2013.01); *B65D 75/12* (2013.01); *B65D 75/26* (2013.01); *B65D 2575/586* (2013.01)

(58) Field of Classification Search

CPC .... B65D 75/5855; B65D 65/14; B65D 75/12; B65D 75/26; B65D 2575/586; B65D 33/20; B65D 65/40; B65D 77/2096; B65B 9/20; B65B 51/02; B65B 61/28

USPC ..... 229/87.01, 80; 383/211, 203, 61.1, 210, 383/84; 156/60; 426/106; 428/40.1

See application file for complete search history.

(56) References Cited

U.S. PATENT DOCUMENTS 4,673,601 A * 6/1987 Lamping ..... B65D 75/52 220/266

5,529,833 A 6/1996 Speer et al.

(Continued)

OTHER PUBLICATIONS

PCT Search Report and Written Opinion for PCT/US2018/059237 dated Jan. 28, 2019 (16 pages).

(Continued)

*Primary Examiner* — Christopher R Demeree

(74) *Attorney, Agent, or Firm* — Barnes & Thornburg LLP; G. Peter Nichols

(57) ABSTRACT

An improved package precursor, resealable package, assembly, and methods and systems for their manufacture. In a first aspect, the precursor comprises a wrapper and at least one primary seal region of the wrapper. The reseal region comprises a cold-seal-adhesive-coated region and is configured to adhere to itself when pressed against itself. The cold-seal-adhesive-coated region can be located on an interior region of the wrapper that does not overlap the primary seal region, thereby avoiding interference with primary seals. The reseal region of the wrapper is configured to form at least a portion of a product containment surface of the package and at least a portion of a product-facing surface of the package. In a second aspect, the improved package precursor forms an improved resealable package for a product. In a third aspect, an assembly comprises the improved resealable package and a product contained by the package.

21 Claims, 18 Drawing Sheets

(51) Int. Cl.
*B65B 51/02* (2006.01)
*B65B 61/28* (2006.01)

(56) References Cited

U.S. PATENT DOCUMENTS 5,945,145 A * 8/1999 Narsutis ..... B65D 75/5838 383/203
6,099,682 A * 8/2000 Krampe ..... B65D 75/5855 156/272.6
8,596,867 B2 * 12/2013 Exner ..... B65D 33/16 383/210
2001/0022867 A1 9/2001 Yeager
2003/0228078 A1 12/2003 Clune
2004/0180118 A1 * 9/2004 Renger ..... B29C 65/743 426/106
2006/0088677 A1 * 4/2006 Mathy ..... B32B 27/08 428/35.7
2007/0104395 A1 * 5/2007 Kinigakis ..... B65D 33/20 383/61.1
2009/0008285 A1 1/2009 Miller
2011/0204056 A1 * 8/2011 Veternik ..... B65D 75/5844 220/270
2011/0229668 A1 9/2011 Doyle
2013/0121623 A1 5/2013 Lyzenga
2015/0030265 A1 1/2015 Stoeppelmann
2016/0023810 A1 1/2016 Zerfas
2016/0068323 A1 * 3/2016 Suryanarayanan .. B65D 75/008 206/459.5
2016/0122109 A1 * 5/2016 Clark ..... B65D 75/5838 220/23.4

OTHER PUBLICATIONS

International Preliminary Report on Patentability, Appl. No. PCT/US2018/059237, dated Feb. 18, 2020.

* cited by examiner

RESEALABLE PACKAGE AND ASSOCIATED MATERIALS, METHODS AND SYSTEMS FOR ITS MANUFACTURE

CROSS-REFERENCE TO RELATED APPLICATIONS

Not applicable.

BACKGROUND

Technical Field

In various embodiments, the present invention relates to an improved resealable package, an improved precursor for the resealable package, and an assembly comprising the package along with a product inside the package. Furthermore, the invention relates to packages with a reseal region configured to provide the package with resealability. For example, the reseal region can be located inside a primary seal region and adjacent to a product. As a portion of the product is consumed, a portion of the reseal region is exposed, and the exposed portion of the reseal region can be adhered to itself using a cold seal adhesive, thereby providing the package with resealability.

Background

The inventor has recognized that many existing packages for products fail to include a closure for resealing the package. If a consumer does not completely consume the product in a single sitting, the remaining product can deteriorate in terms of freshness, organoleptic properties, or other desirable characteristics.

Furthermore, while some existing packages do include the ability to reseal, for example, using zippers or other conventional closures, the inventor realized that these closures can be expensive. For example, the closures themselves add costs to packaging materials, and the process required to add the closures can require retrofitting packaging lines by adding new equipment and modifying existing equipment. These modifications require time, maintenance staff, and can significantly impede use of a production line and interrupt production schedules.

Advantageously, the inventor has discovered improved packaging materials and related processes that, at least in some embodiments, can mitigate or eliminate one or more of the previously mentioned problems. These and additional advantages associated with various embodiments of the improved packaging materials and related processes will be further evident to a person having ordinary skill in the art upon reviewing the present disclosure.

SUMMARY OF THE INVENTION

In a first aspect, the invention provides an improved package precursor for an improved resealable package. The precursor comprises a wrapper and at least one primary seal region of the wrapper. The reseal region of the wrapper is configured to adhere to itself when pressed against itself, comprises a cold-seal-adhesive-coated region, is configured to form at least a portion of a product containment surface of the package, and is configured to form at least a portion of a product-facing surface of the package.

In a second aspect, the invention provides an improved resealable package for a product. The package comprises one or more of the following features: a precursor; a product-facing surface; at least one primary seal; and a product containment surface. A wrapper of the precursor is adhered to itself along at least one primary seal region of the wrapper to provide the at least one primary seal of the package and a product containment space within the package. The product containment space is bound by the product-facing surface of the package and the at least one primary seal of the package.

In a third aspect, the invention provides an assembly comprising an improved resealable package and a product contained by the package.

In a fourth aspect, the invention provides a method for making an improved package precursor for an improved resealable package. The method comprises several steps. A first step is providing a wrapper comprising at least one primary seal region and a reseal region, and a second step is depositing a cold seal adhesive on the reseal region to provide a cold-seal-adhesive-coated region of the wrapper. The reseal region is configured to form at least a portion of a product containment surface of the package and configured to form at least a portion of a product-facing surface of the package.

In a fifth aspect, the invention comprises a method for making an improved resealable package. The method comprises several steps. A first step comprises making a precursor. A second step comprises adhering at least one primary seal region of the wrapper to itself or adhering a first seal region in the at least one primary seal region to a second seal region in the at least one primary seal region, or a combination thereof, thereby forming at least one primary seal of the package and forming a product containment space of the package. The product containment space is bound by the at least one primary seal and a product containment surface of the package. The product containment surface of the package comprises at least a portion of the reseal region, and the reseal region of the wrapper forms at least a portion of the product-facing surface of the package.

In a sixth aspect, the invention provides a method for making an assembly comprising a product and an improved resealable package for the product. The method comprises making an improved resealable package so that forming a product containment space of the package comprises forming the product containment space around the product.

Other aspects, embodiments and features of the invention will become apparent from the following detailed description of the invention when considered in conjunction with the accompanying drawings. The accompanying figures are schematic and are not intended to be drawn to scale. In the figures, each identical, or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Among other discoveries, as disclosed herein, the inventor has discovered that a packaging precursor, for example, a wrapper for an existing product, can be coated with a cold seal adhesive to provide a reseal region of the wrapper and resealability for a package made using the wrapper. If the coated region is an interior region of the wrapper or another region that does not overlap the primary seal regions of the wrapper, interference with the primary seals can be avoided. For example, if cold seal adhesive is deposited on an interior region of a wrapper, and the edge regions of the wrapper are not coated with the cold seal adhesive, heat seal jaws or a primary adhesive can be used to form primary seals along the edges of the wrapper, and the sealing and barrier properties of these primary seals can be generally maintained as though no cold seal adhesive were applied to the wrapper.

In developing various embodiments of improved packaging materials and processes for making these packaging materials, the inventor realized several potential advantages for the improved materials, systems and/or processes described herein. For example, as compared to packages without resealability, the improved packages can help to maintain the freshness, organoleptic properties, or other desirable characteristics of a product contained within the package.

Additionally, as compared to packages that use conventional means for resealing, for example, zippers, the improved packages can be made less expensively. For example, with respect to material costs, the cost of the cold seal adhesive can be significantly less expensive than the cost of an added closure such as a zipper. Similarly, the cost of equipment for coating a wrapper with cold seal adhesive can be significantly less expensive than equipment for incorporating an added closure, such as a zipper, into a wrapper or package.

Moreover, the improved packages can be made using existing equipment, such as existing form, fill, and seal machines. For example, in some embodiments, an improved package precursor, comprising a wrapper and cold seal adhesive, can be fed to a form, fill and seal machine in a manner that is similar or identical to the way that a package precursor without the cold seal adhesive would be fed to the form, fill and seal machine. Furthermore, the cold seal adhesive can be deposited on the wrapper using existing printing or deposition equipment for depositing adhesive, ink, pigment, other materials, or a combination thereof on the wrapper. Accordingly, in conjunction with some embodiments of the improved packaging materials, a product packaging line for a non-resealable package can be quickly and inexpensively converted into a product packaging line for a resealable package.

Figure 1:
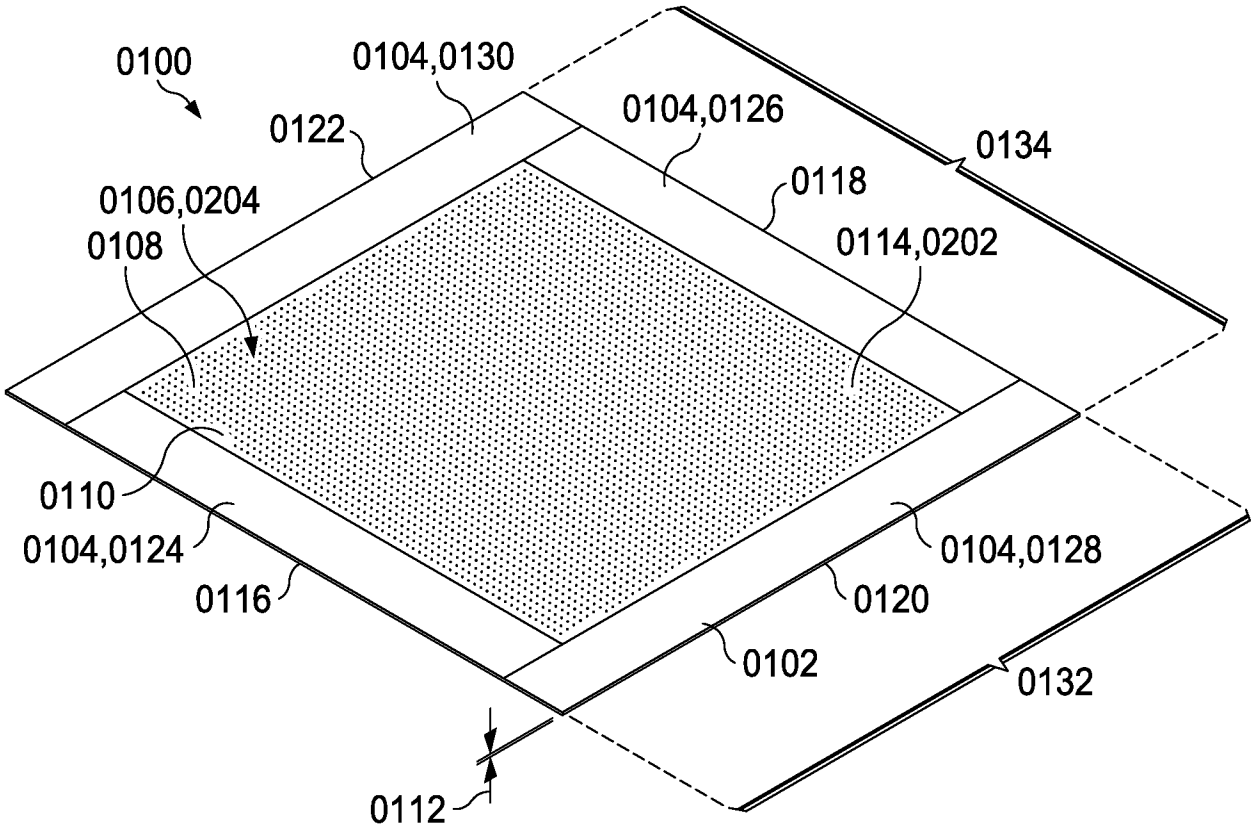
FIG. 1 is a schematic illustration of a package precursor for an improved resealable package comprising a wrapper and cold seal adhesive.
Figure 2:
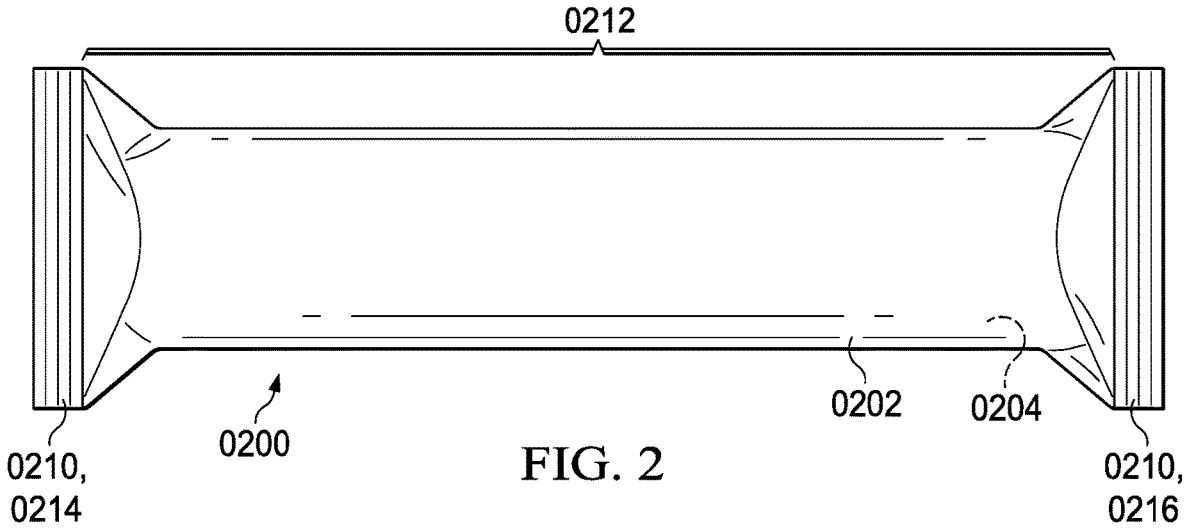
FIG. 2 is a schematic illustration of a resealable package, which can be made from a precursor comprising a wrapper and cold seal adhesive.
Figure 3:
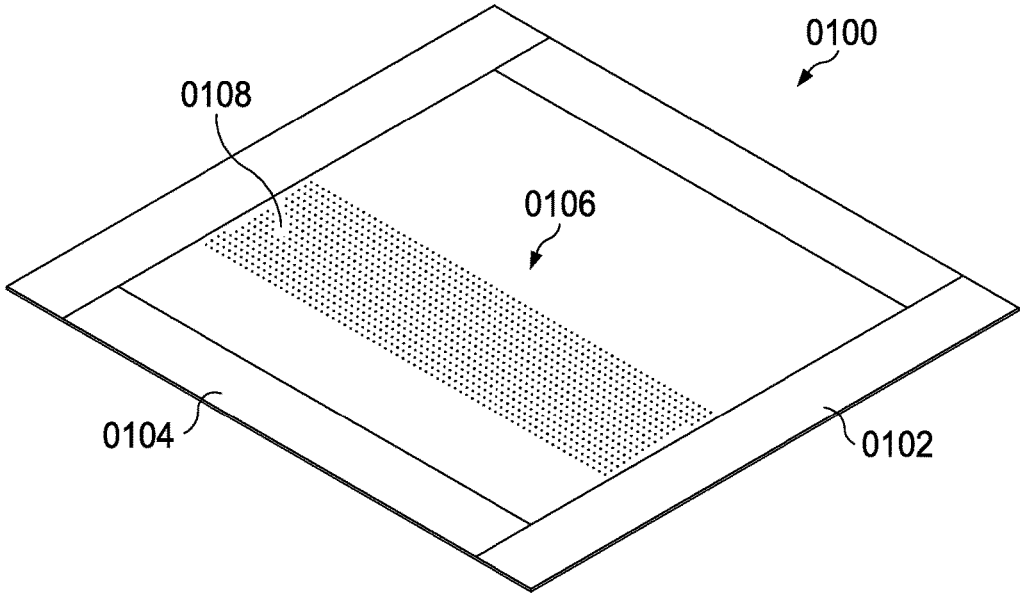
FIG. 3 is another schematic illustration of a package precursor for an improved resealable package comprising a wrapper and cold seal adhesive.

With reference now to FIG. 1 and FIG. 2, an embodiment of an improved package precursor 0100 for an improved resealable package 0200, will now be described. As illustrated, the precursor 0100 comprises: a wrapper 0102, at least one primary seal region 0104 of the wrapper 0102, and a reseal region 0106 of the wrapper 0102.

Turning first to the wrapper of the precursor, the wrapper 0102 can comprise a first end 0116, a second end 0118, a first edge 0120, a second edge 0122 or a combination thereof. In the illustrated embodiment, the second end 0118 is opposite the first end 0116, and the second edge 0122 is opposite the first edge 0120. Additionally, (i) the first end 0116 of the wrapper can be adjacent to the first edge 0120, the second edge 0122 or both the first edge 0120 and the second edge 0122 of the wrapper; (ii) the second end 0118 of the wrapper can be adjacent to the first edge 0120, the second edge 0122 or both the first edge 0120 and the second edge 0122 of the wrapper; (iii) the first edge 0120 of the wrapper can be adjacent to the first end 0116, the second end 0118 or both the first end 0116 and the second end 0118 of the wrapper; and (iv) the second edge 0122 of the wrapper can be adjacent to the first end 0116, the second end 0118 or both the first end 0116 and the second end 0118 of the wrapper.

Figure 12:
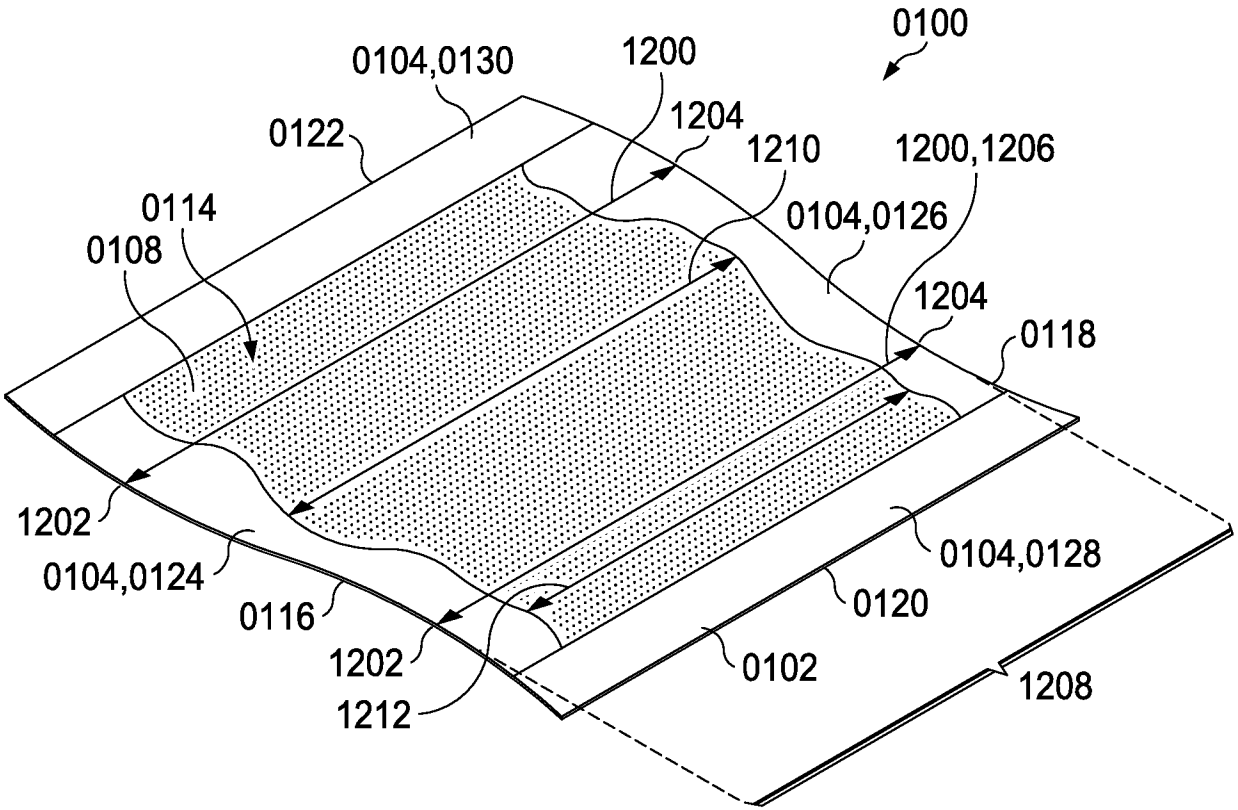
FIG. 12 is a schematic illustration of a precursor comprising a wrapper and a product containment region that depicts approaches to measuring the length of the product containment region and the length of the wrapper, even if the wrapper or the product containment region have irregular shapes.

In some embodiments, the first end 0116 is separated from the second end 0118 by a minimum length 0132 of the wrapper 0102. In some embodiments, the first edge 0120 is separated from the second edge 0122 by a minimum width 0134 of the wrapper 0102. Additionally, because a wrapper can have an irregular shape, it can be useful to provide generalized definitions of length and width to facilitate determining the dimensions of irregularly shaped wrappers. Accordingly, as illustrated with reference to FIG. 12, a length reference line 1200 for the wrapper 0102 can be defined as a line from any first end point 1202 on the first end 0116 of the wrapper 0102 to any second end point 1204 on the second end 0118 wrapper 0102. Furthermore, a minimum length reference line 1206 can be defined as the length reference line 1200 with the shortest length. Then, using these definitions, a minimum length 1208 of the wrapper 0102 can be defined as the length of the minimum length reference line 1206.

In some embodiments, the minimum length 1208 of the wrapper 0102 is at least 15, 20, 25, 26, 27, 28, 29 or 30 cm; no more than 15, 20, 25, 26, 27, 28, 29 or 30 cm; or a combination thereof. In some embodiments, the maximum length of the wrapper is at least 30, 31, 32, 33, 34, 35, 40 or 60 cm; no more than 30, 31, 32, 33, 34, 35, 40 or 60 cm; or a combination thereof. In some embodiments, a maximum length 1210 of the product containment region 0114 in a direction parallel to the minimum length reference line 1206 is at least 1, 2, 3, 4, 5, 10, 15, 20, 25, 26, 27, 28, 29, or 29.5 cm; no more than 1, 2, 3, 4, 5, 10, 15, 20, 25, 26, 27, 28, 29, or 29.5 cm; or a combination thereof. In some embodiments, a minimum length 1212 of the product containment region 0114 in a direction parallel to the minimum length reference line 1206 is at least 1, 2, 3, 4, 5, 10, 15, 20, 25, 26, 27, 28, 29, or 29.5 cm; no more than 1, 2, 3, 4, 5, 10, 15, 20, 25, 26, 27, 28, 29, or 29.5 cm; or a combination thereof.

Figure 13:
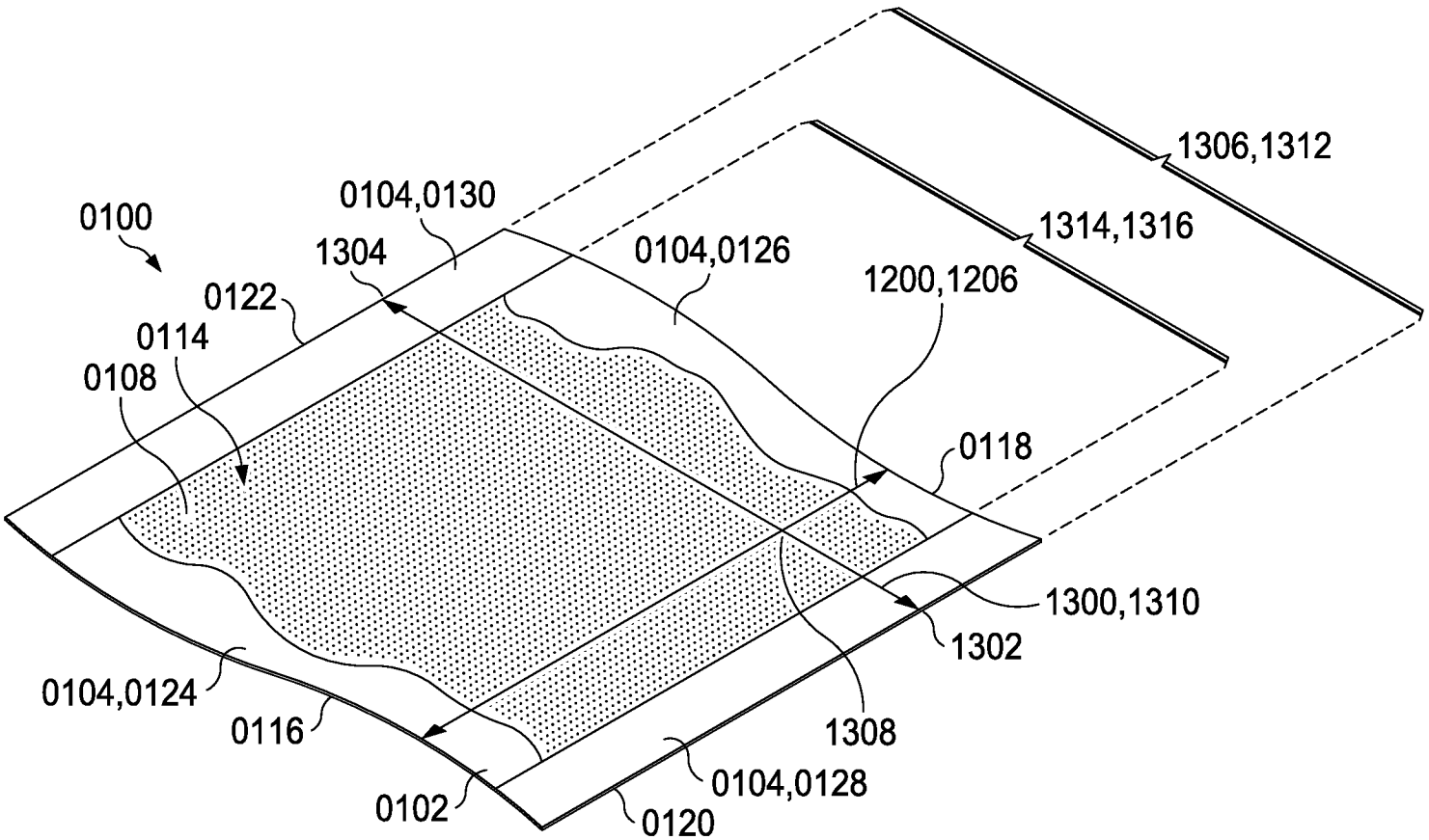
FIG. 13 is a schematic illustration of a precursor comprising a wrapper and a product containment region that depicts approaches to measuring the width of the product containment region and the width of the wrapper, and further depicting how both a minimum dimension and a maximum dimension, such as minimum and maximum width along the product containment region and minimum and maximum width along the wrapper, can be the same when a wrapper or region is regular, for example, having opposite edges that are straight and parallel.

With reference to FIG. 13, a width reference line 1300 can be defined as a line that is perpendicular to the minimum length reference line 1206 and extends from any first edge point 1302 on the first edge 0120 of the wrapper 0102 to any second edge point 1304 on the second edge 0122 of the wrapper 0102.

As can be seen with reference to FIG. 13, a width 1306 of the wrapper 0102 at any reference point 1308 along the minimum length reference line 1206 can be measured from the first edge 0120 of the wrapper 0102 to the second edge 0122 of the wrapper 0102 and along the width reference line 1300 passing through the reference point 1308.

With reference to these definitions, it can be useful to define a minimum width reference line 1310 as the width reference line 1300 with the shortest width. Similarly, it can be useful to define a minimum width 1312 of the wrapper 0102 as the width of the minimum width reference line 1310. In some embodiments, the minimum width 1312 of the wrapper 0102 is at least 10, 15, 16, 17, 18, 19 or 20 cm; no more than 10, 15, 16, 17, 18, 19 or 20; or a combination thereof. In some embodiments, a maximum width 1314 of the product containment region 0114 in a direction parallel to the minimum width reference line 1310 is at least 1, 2, 3, 4, 5, 10, 11, 12, 13, 14, 15, 16, 17, 18, 19, or 19.5 cm; no more than 1, 2, 3, 4, 5, 10, 11, 12, 13, 14, 15, 16, 17, 18, 19, or 19.5 cm; or a combination thereof. Furthermore, in some embodiments, a minimum width 1316 of the product containment region 0114 in a direction parallel to the minimum width reference line 1310 is at least 1, 2, 3, 4, 5, 10, 11, 12, 13, 14, 15, 16, 17, 18, 19, or 19.5 cm, no more than 1, 2, 3, 4, 5, 10, 11, 12, 13, 14, 15, 16, 17, 18, 19, or 19.5 cm, or a combination thereof.

As a person having ordinary skill in the art would understand after reading the present disclosure, the wrapper can be made using any appropriate materials. As an example, in some embodiments, the wrapper 0102 comprises film, polymer, plastic, thermoplastic, metal, paper, or a combination thereof. Additionally, the wrapper can be provided with desirable structural characteristics, as the skilled person would also understand after reading the present disclosure. For example, in some embodiments, the wrapper 0102 can comprise at least one element selected from the following group of elements: bi-oriented film, polypropylene film, clear film, metallized film, aluminum-metallized film, at least two layers, 10-20 gauge film, 15 gauge film, or a combination thereof.

Figure 10:
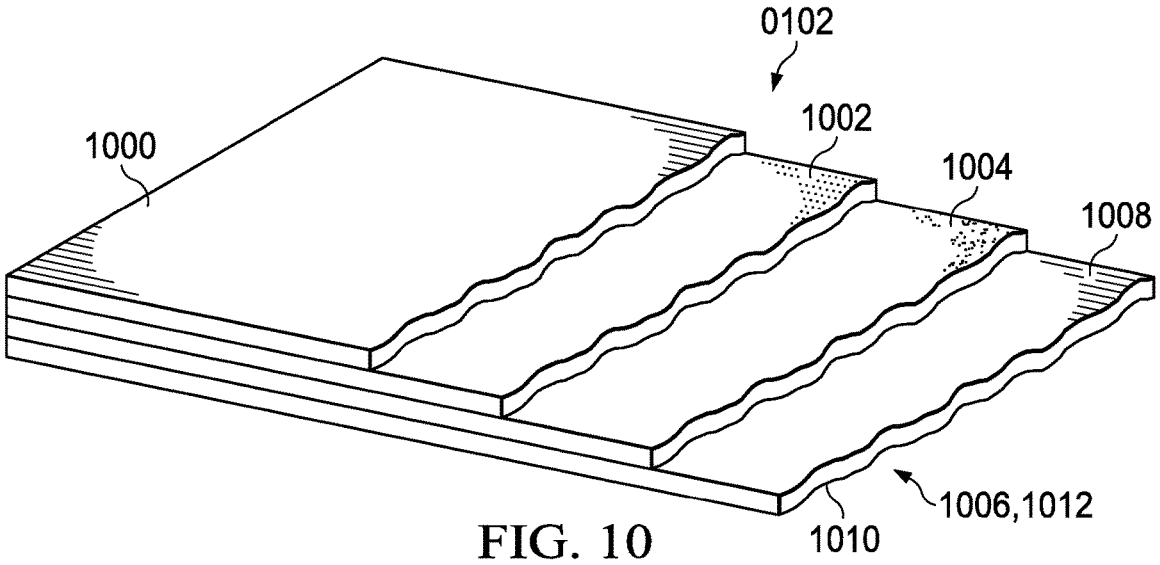
FIG. 10 is a schematic illustration of a wrapper comprising layers and deposits that include a primary film layer, at least one color deposit, at least one adhesive deposit, and a barrier layer.
Figure 11:
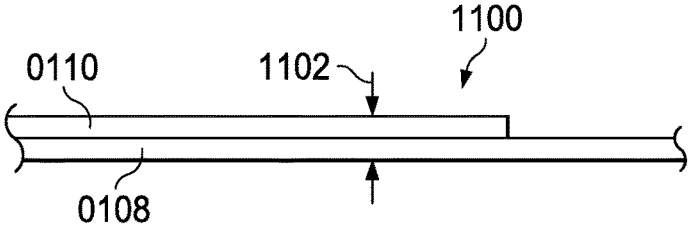
FIG. 11 is a schematic illustration of a cold seal adhesive layer applied to a cold-seal-adhesive coated region.

With reference to FIG. 10, in some embodiments, the wrapper 0102 can be made from one or more layers or deposits. For example, the wrapper 0102 can comprise layers and/or deposits selected from the group consisting of: a primary layer 1000, an ink deposit 1002 (e.g., comprising any ink deposited on the primary layer 1000, which primary layer 1000 can be clear), an adhesive deposit 1004, a barrier layer 1006, a print layer, a product 0206 facing layer (e.g., the barrier layer 1006), and a combination thereof. Additionally, the wrapper 0102 can comprise a plurality of layers and deposits arranged in the following order: a primary layer 1000, an ink deposit 1002, an adhesive deposit 1004, and a barrier layer 1006.

With reference to FIG. 10, the barrier layer 1006 can be adhered (directly or indirectly) to the primary film layer 1000. In some embodiments, at least one ink deposit 1002, at least one color deposit 1002, at least one adhesive deposit 1004, at least one non-film layer, or a combination thereof are positioned between the primary film layer 1000 and barrier layer 1006.

The primary film layer 100 can comprise bi-axially oriented polypropylene, be clear, be reverse printed, or a combination thereof. Additionally, the primary film layer 1000 is configured to form a portion of the wrapper 0102 that is separated from the product 0206 by the barrier layer 1006. In some embodiments, the primary film layer 1000 is configured to be a print layer. Optionally, the print layer (e.g., including any decoration, message, information, etc.) is configured to form a portion of the wrapper 0102 that is visible from an exterior of the wrapper 0102. Moreover, the primary film layer 1000 can be reverse printed on the surface of the primary film layer 1000 that is adjacent to the barrier layer 1006, or a combination thereof. In some embodiments, the primary film layer can have a thickness of 10-20 gauge (e.g. 15 gauge) or can have a thickness of 10-30 micron, 10-20 micron (e.g. 15 micron), or 20-30 micron (e.g., 25 micron).

The barrier layer 1006 can comprise bi-axially oriented polypropylene, be clear, be metallized (e.g., with aluminum) or a combination thereof. The barrier layer 1006 can comprise a barrier film layer 1008, a metal layer 1010, a metallized barrier film layer 1012, or a combination thereof. Optionally, the barrier layer 1006, barrier film layer 1008, metal layer 1010, or metallized barrier film layer is configured to be on a product-facing surface 0204 of the wrapper 0102 that is adjacent to the product 0206. In some embodiments, the barrier film layer 1008 has a thickness of 10-20 gauge (e.g., 15 gauge) or a thickness of 10-20 micron (e.g., 15 micron).

Turning next to the at least one primary seal region 0104 of the wrapper, it can comprise: a first end seal region 0124, a second end seal region 0126, a first longitudinal seal region 0128, a second longitudinal seal region 0130, or a combination thereof. As illustrated, the first end seal region 0124 is configured (e.g., positioned, oriented, made of materials, designed, or a combination thereof) to provide a first end seal 0214 for the package 0200. The first end seal region 0124 of the wrapper is adjacent to a first end 0116 of the wrapper. Similarly, the second end seal region 0126 is configured to provide a second end seal 0216 for the package 0200, and the second end seal region 0126 of the wrapper is adjacent to the second end 0118 of the wrapper.

If a package is made, for example, from a wrapper that forms a closed surface or closed loop in at least one direction (e.g., a cylinder), then the package can be made using only end seals. However, when a package is made from a flat wrapper that does not form a closed surface or closed loop, as illustrated in FIG. 1, it can be useful for the package to include longitudinal seals, to provide the structural effect of a wrapper with a closed surface or closed loop.

Accordingly, as illustrated in FIG. 1, a wrapper 0102 can comprise a first longitudinal seal region 0128 and a second longitudinal seal region 0130. As illustrated, the first longitudinal seal region 0128 is adjacent to the first edge 0120, and the second longitudinal seal region 0130 is adjacent to the second edge 0122. Furthermore, with reference to FIG. 1 and FIG. 2, the first longitudinal seal region 0128 and the second longitudinal seal region 0130 are configured (e.g., positioned, oriented, made of materials, designed, or a combination thereof) to provide a longitudinal seal 0900 (e.g., lap seal, fin seal, etc.) for a package 0200.

In some embodiments, the at least one primary seal region 0104 of the wrapper 0102 (e.g., first end seal region 0124, second end seal region 0126, first longitudinal seal region 0128, second longitudinal seal region 0130, or a combination thereof) can be sealed using energy (e.g., using heat, seal jaws, pressure, electromagnetic energy, ultrasonic waves, radiation, infrared radiation, light, or a combination thereof) to melt the wrapper 0102 in the at least one primary seal region 0104 so that the at least one primary seal region 0104 sticks to itself or a corresponding seal region (e.g., another seal region described herein) to form at least one primary seal 0210. Accordingly, in some embodiments, the at least one primary seal region 0104 of the wrapper 0102 comprises or is a thermoplastic.

Additionally, in some embodiments, the at least one primary seal region 0104 of the wrapper 0102 (e.g., first end seal region 0124, second end seal region 0126, first longitudinal seal region 0128, second longitudinal seal region 0130, or a combination thereof) can be sealed using an adhesive coating on the at least one primary seal region 0104 so that the at least one primary seal region 0104 sticks to itself or a corresponding seal region (e.g., another seal region described herein) to form at least one primary seal 0210.

In some embodiments, an adhesive used in the at least one primary seal region 0104 (e.g., the first end seal region 0124, second end seal region 0126, first longitudinal seal region 0128, second longitudinal seal region 0130, or a combination thereof) is selected from the group consisting of: cold seal adhesive, non-resealable adhesive, permanent adhesive and a combination thereof.

As illustrated in the embodiments of FIG. 1 and FIG. 2, the wrapper 0102 comprises a product containment region 0114, which is configured to provide a product containment surface 0202 of the package 0200. In turn, the product containment surface 0202 and the at least one primary seal region 0104 of the wrapper are configured to provide a boundary for a product containment space 0212 within the package 0200. Additionally, at least one primary seal 0210 of the package 0200 comprises the at least one primary seal region 0104 of a wrapper 0102.

After the primary seal is opened by a consumer, the primary seal can lose its ability to provide a closure for the package. Accordingly, the at least one reseal region 0106 of the wrapper 0102 is configured to provide resealability for the package 0200 after opening the at least one primary seal 0210.

As illustrated in FIG. 1 and FIG. 2, the reseal region 0106 is configured to form at least a portion (e.g., at least 5, 10, 15, 20, 25, 30, 35, 40, 35, 50, 55, 60, 65, 70, 75, 80, 85, 90, 95, or 100%) of a product containment surface 0202 and/or product-facing surface 0204 of the package 0200. Furthermore, in the illustrated embodiment, the product-facing surface 0204 of the package 0200 is located within a boundary formed by the at least one primary seal region 0104 (e.g. the first end seal region 0124, the second end seal region 0126, the first longitudinal seal region 0128, the second longitudinal seal region 0130, or a combination thereof).

Turning now to the reseal region of the wrapper, the reseal region 0106 is configured to adhere to itself when pressed against itself (e.g., by folding, twisting, etc.), for example, as a result of an adhesive that is deposited on the reseal region of the wrapper. If the adhesive is of a kind that adheres to surfaces in general, it is sufficient to coat only one of two reseal portions that are configured to be mutually adhered. While this can be acceptable in some packaging embodiments, it can create issues with respect to undesired adhesion. For example, if a surface that is coated with adhesive is adjacent to a product, then the coated surface could adhere unintentionally to the product.

In contrast, the use of a cold seal adhesive can reduce or completely avoid unintentional adhesion. For example, when a cold seal adhesive is deposited on a portion of the reseal region, adherence to surfaces that are not coated with the cold seal adhesive can be avoided. Meanwhile, by coating two portions of the reseal region with cold seal adhesive and then pressing the two portions together, the two portions can be adhered to each other. Accordingly, it can be advantageous to use a cold seal adhesive, as opposed to other types of adhesive, to provide adherence between different portions of the reseal region.

As an example, FIG. 1 illustrates a reseal region comprising a cold-seal-adhesive-coated region 0108. Cold seal adhesive 0110 is deposited on the cold-seal-adhesive-coated region 0108 of the wrapper 0102. Accordingly, the cold-seal-adhesive coated region 0108 can be pressed against itself to form a reseal closure. Optionally the cold-seal-adhesive-coated region 0108 is co-extensive with the reseal region. For example, the reseal region can be the cold-seal-adhesive-coated region. Furthermore, in some embodiments, the cold-seal-adhesive-coated region 0108 of the wrapper 0102 is configured to provide the product-facing surface 0204 of the package 0200, an inner surface of the package 0200, or a combination thereof. As explained herein, using a cold seal adhesive on a product-facing surface or inner surface of a package can be advantageous because the cold seal adhesive can be configured to avoid adhesion to the product.

In some embodiments, a cold seal adhesive 0110 applied to the cold-seal-adhesive-coated region 0108 is a water-based emulsion. In some embodiments, a cold seal adhesive

0110 is applied to the cold-seal-adhesive-coated region 0108 in a cold seal adhesive layer 1100 having a thickness 1102 equal to 1-5, 1-4, 2.5-3.5 or about 3 microns.

Additionally, upon reading the present disclosure, a skilled person would understand that various embodiments of a wrapper with different shapes and configurations can be used to provide a primary seal region and a reseal region for an improved resealable package. As an example, in some embodiments, the wrapper 0102 is shaped like a rectangle (e.g., square). Similarly, in some embodiments, the first end seal region 0124, second end seal region 0126, first longitudinal seal region 0128, second longitudinal seal region 0130, reseal region 0106, cold-seal-adhesive-coated region 0108, product-facing surface 0204, product containment surface 0202, or a combination thereof is shaped like a rectangle (e.g., square).

Figure 4:
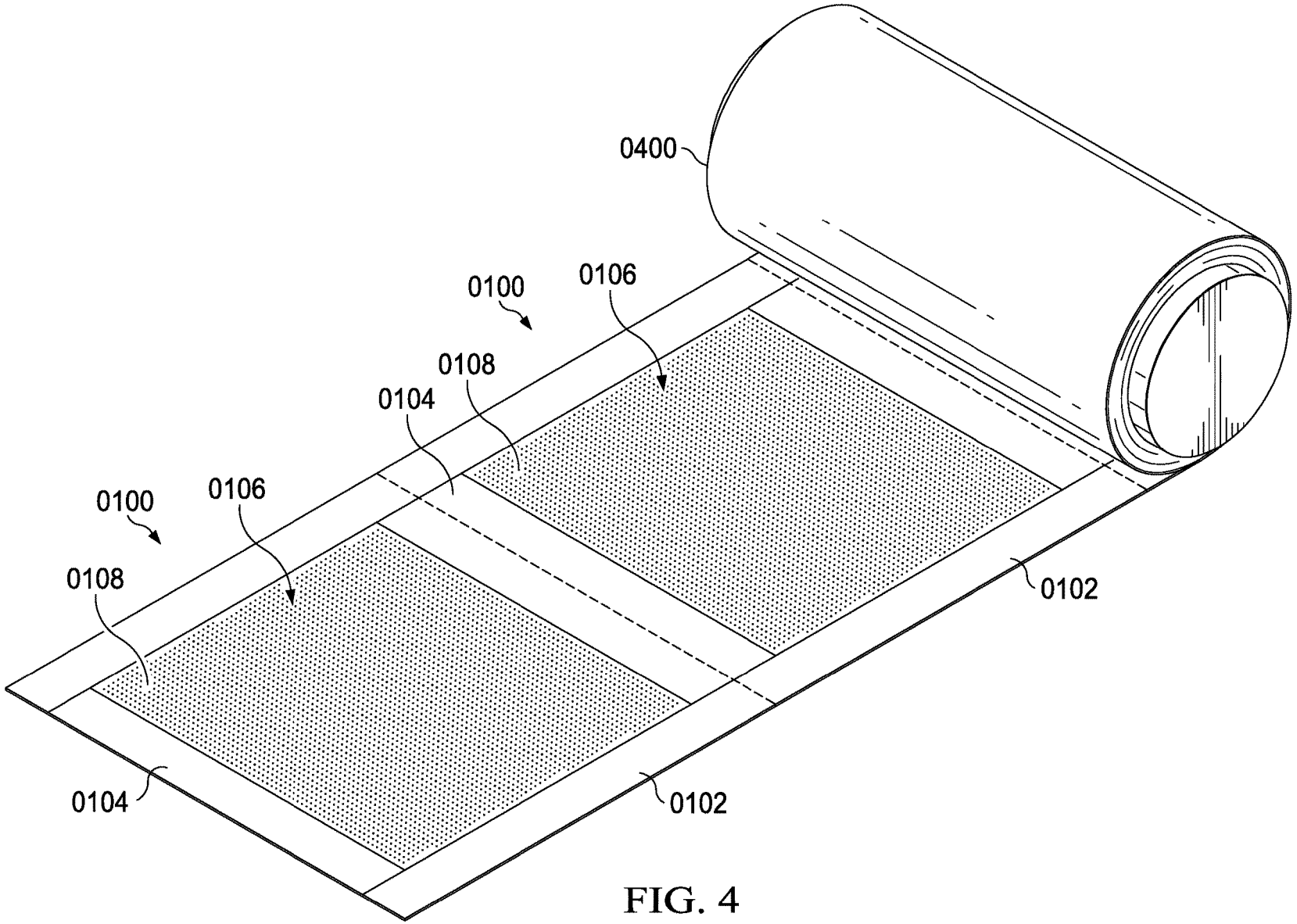
FIG. 4 is a schematic illustration of a roll comprising a plurality of package precursors for resealable packages.

With reference now to FIG. 4, in some embodiments, a precursor 0100 is configured to provide a roll 0400 of the wrapper 0102. Optionally, the roll 0400 comprises a plurality of precursors 0100, a plurality of the at least one primary seal regions 0104, a plurality of the reseal regions 0106, or a combination thereof.

Figure 5:
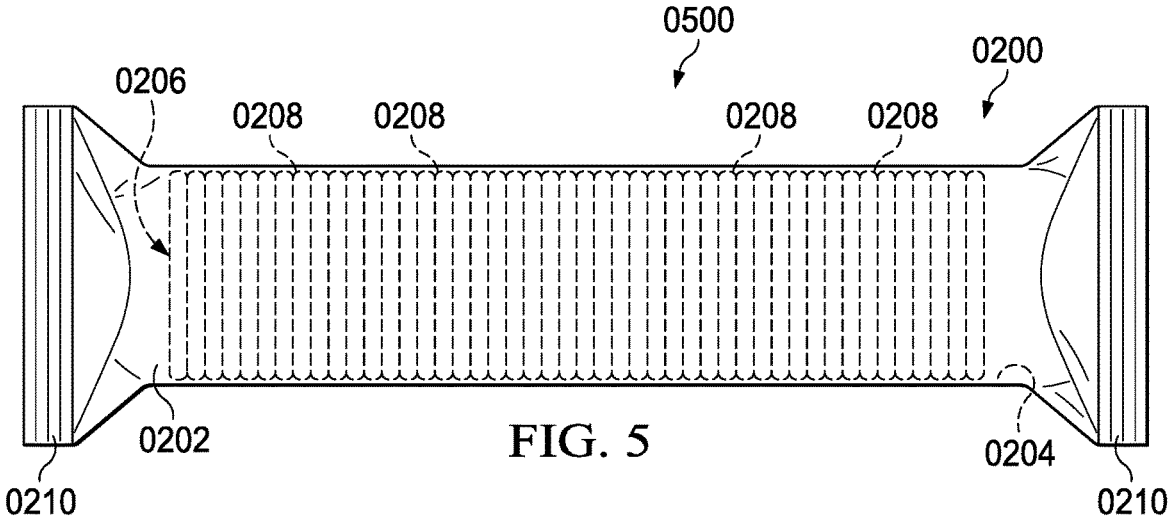
FIG. 5 is a schematic illustration of an assembly comprising a resealable package and a product contained by the resealable package.
Figure 6:
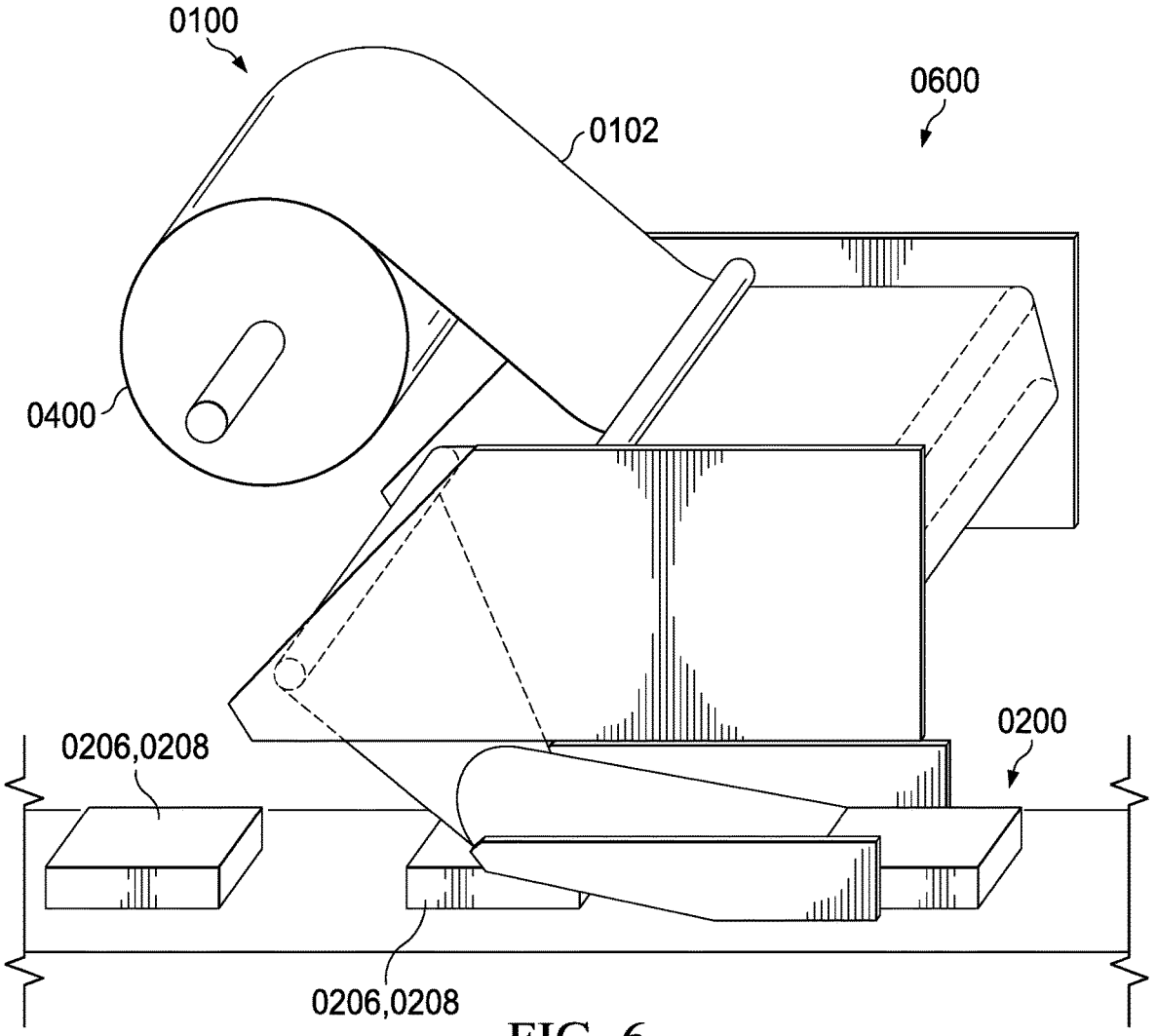
FIG. 6 is a schematic illustration of a form, fill and seal machine, which is being fed a product and a roll of precursors and is forming an assembly comprising a resealable package around the product.

With reference to FIG. 5 and FIG. 6, the precursor 0100 can be configured to be fed with the product 0206 (e.g. a plurality of product units 0208) to a form, fill and seal machine 0600 and the form, fill and seal machine 0600 forms the precursor 0100 into at least one package 0200 that contains the product 0206. As an example, the form, fill and seal machine 0600 can form the precursor into a plurality of packages 0200, and each package 0200 can comprise at least one of the product units 0208 or a plurality of the product units 0208.

With reference again to FIG. 1 and FIG. 2, the at least one primary seal region 0104 of the wrapper 0102 is configured to form at least one primary seal 0210 (e.g., a heat seal, ultrasonic weld, permanent seal, adhesive bond, non-resealable seal or combination thereof) for the package 0200. In some embodiments, the at least one primary seal 0210 does not comprise cold seal adhesive 0110. This can be useful, for example, when the cold seal adhesive could interfere with formation of the primary seal.

Figure 7:
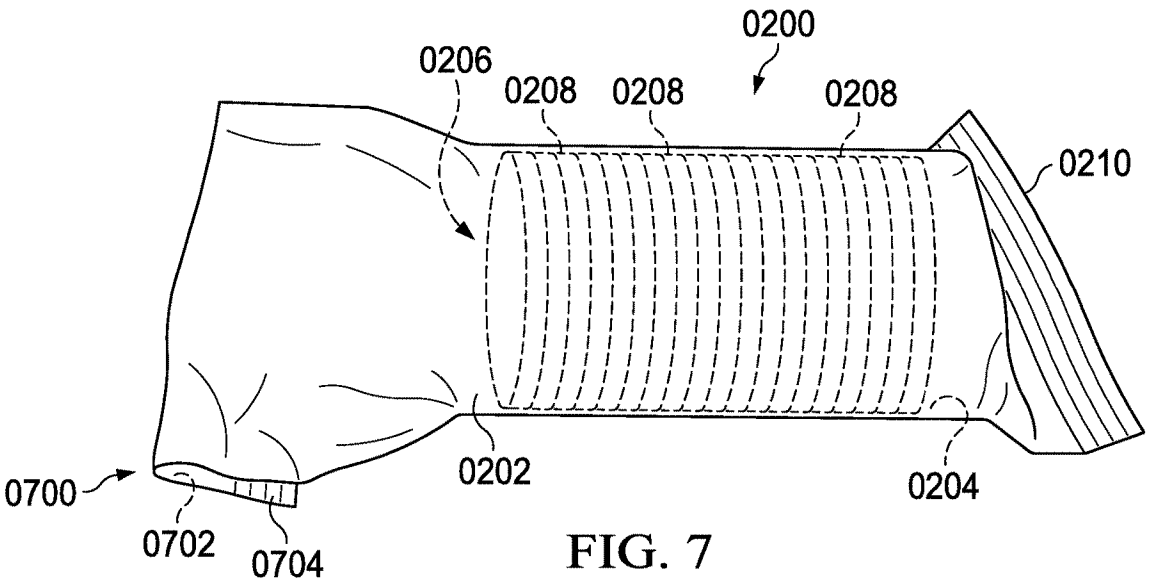
FIG. 7 is a schematic illustration of a reseal closure formed by folding a resealable package.
Figure 8:
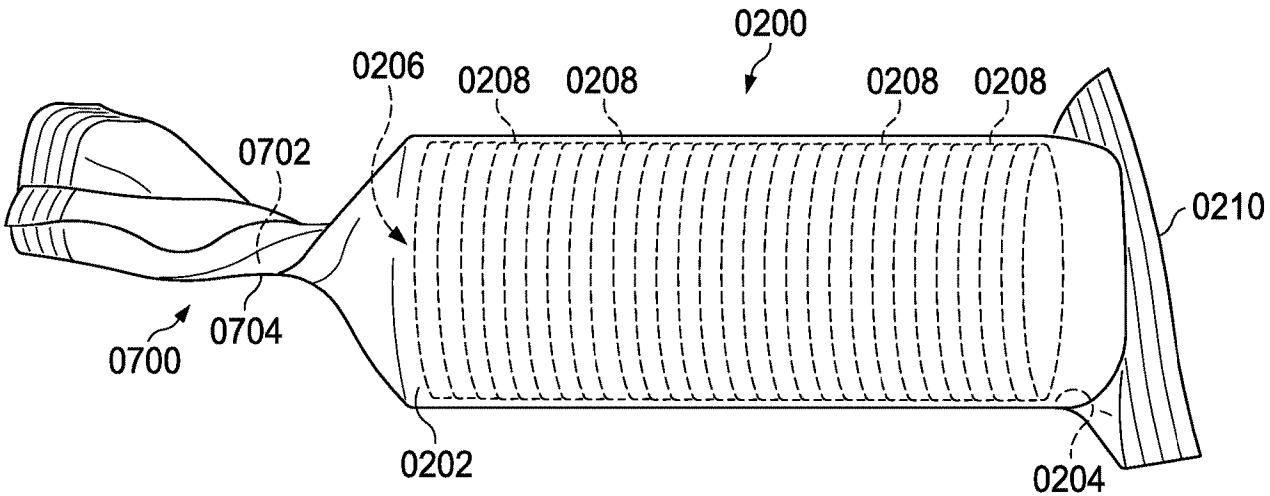
FIG. 8 is a schematic illustration of a reseal closure formed by twisting a resealable package.

With reference to FIG. 1, FIG. 2, and FIG. 7, the reseal region 0106 is configured to form a reseal closure 0700 by adhering a first portion 0702 of the reseal region 0106 to a second portion 0704 of the reseal region 0106. In some embodiments, the cold seal adhesive 0110 provides a reseal closure 0700 that has a maximum seal strength of at least 0.56, 1.1, 2.2, 3.3, 4.4, 8.9, 13, 17, or 22 N/15 mm seal width (0.125, 0.25, 0.5, 0.75, 1, 2, 3, 4 or 5 lb-f/in. seal width), no more than 0.56, 1.1, 2.2, 3.3, 4.4, 8.9, 13, 17, or 22 N/15 mm seal width (0.125, 0.25, 0.5, 0.75, 1, 2, 3, 4 or 5 lb-f/in. seal width), or a combination thereof. This maximum seal strength value can be the value associated with a continuous cold seal adhesive layer adhered to another continuous cold seal adhesive layer. Alternatively, it can be the maximum seal strength provided when a first cold seal layer with a corresponding first configuration as applied to the wrapper is pressed against a second cold seal layer with a corresponding second configuration as applied to the wrapper, noting that the first and second configuration can be the same or different. A higher maximum seal strength can be useful, for example, to prevent a reseal closure from opening unintentionally. The seal strength can be measured by providing a discrete portion of the wrapper comprising two sheets of the wrapper that are each coated with cold seal adhesive and that are pressed together between two flat plates using 5 psi at 25° C. for 0.5 seconds to provide the seal while leaving an unsealed portion of each sheet, thereby providing a single interface that extends along the sealed and unsealed portions of both of the two sheets. The interface between the sealed and unsealed portions is 15 mm wide, thereby providing the 15 mm seal width. To determine the maximum seal strength, one of the unsealed portions of the wrapper is pulled in a direction opposite the other unsealed portion of the wrapper while the seal between the two sheets is supported (e.g., by hand) at 90 degrees to the pull direction, thereby causing a seal failure along the 15 mm seal width. While the unsealed portion of the wrapper is pulled, the pull force is measured and the maximum force measured is the maximum seal strength.

With reference to FIG. 1 and FIG. 2, in some embodiments, the wrapper 0102 is configured to form a package 0200 for the product 0206 with specified barrier properties that are sufficient to satisfy a product quality test. The product 0206 quality test comprises providing the product 0206 in the package 0200 with at least one initial product characteristic at an initial time, and storing the package 0200 in air at 40° C. and 80% relative humidity from the initial time to a final time that occurs 8 weeks after the initial time. Then, at least one final characteristic of the product 0206 is measured at the final time.

In conducting the product quality test, the at least one initial characteristic is selected from the group consisting of: a moisture content equal to 2.18 wt. %+/−10, 5, 4, 3, 2, 1, or 0%, a water activity equal to 0.17+/−10, 5, 4, 3, 2, 1, or 0%, a force required to break the product 0206 equal to 3.00 kg-force +/−10, 5, 4, 3, 2, 1, or 0% (e.g., as measured using a texturometer), a color intensity of 3.91+/−10, 5, 4, 3, 2, 1, or 0% wherein the color intensity is equal to the L coordinate of the color of the product in the CIEL*a*b* 1976 color space as measured using a colorimeter, and a combination thereof. Accordingly, the at least one final characteristic is selected from the group consisting of: a moisture concentration equal to no more than 4.0, 3.5, 3.0, or 2.84 wt. %, a water activity equal to no more than 0.40, 0.35, 0.30, or 0.25, a force required to break the product 0206 equal to at least 2.40, 2.50, 2.60 or 2.70 kg-force (e.g., as measured using a texturometer), a color intensity of 4.06%+/−10, 5, 4, 3, 2, 1, or 0% wherein the color intensity is equal to the L coordinate of the color of the product in the CIEL*a*b* 1976 color space as measured using a colorimeter, and a combination thereof.

In some embodiments, the wrapper 0102 is configured to form a package 0200 for the product 0206 with specified barrier properties that are sufficient to satisfy a product quality test. The product quality test comprises providing the product 0206 in the package 0200 and storing the package 0200 for 10 weeks in air at 40° C. and 80% relative humidity. The product 0206 quality test is satisfied if the product 0206: has a total count of colony forming units per gram (CFU/g) that is less than 5,000, 4,000, 3000, 2000, 1000, 500, 400, 300, 200, 100, 50, 40, or no more than 30 CFU/g as measured per PEM-008, has a total coliforms count that is less than 20, 15, 14, 13, 12, 11, or 10 CFU/g as measured per method PEM-010, has a mold count that is less than 100, 90, 80, 70, 60, 50, 40, 30, 20 or no more than 10 CFU/g as measured per PEM-009, has a yeast count that is less than 100, 90, 80, 70, 60, 50, 40, 30, 20 or 10 CFU/g as measured per PEM-009, tests negative for *salmonella* in 10 grams of the product 0206 per PEM-016, tests negative for *Escherichia coli* in 10 grams of the product 0206 per PEM-028, or a combination thereof.

With reference to FIG. 18, FIG. 19, FIG. 20, FIG. 21, FIG. 22, FIG. 23 and FIG. 24, in some embodiments the product (i.e., Gamesa Marias brand cookies) is stored in the package in air at 40° C. and 80% relative humidity for a specified time (i.e. "Storage Time") illustrated in FIGS. 18-24. The product being stored in the improved resealable package whose barrier properties are being tested is labeled with a "T" in FIGS. 18-24. Upon storage for the specified time, the product is removed from storage and removed from the improved resealable package and various sensed characteristics (e.g., organoleptic properties) listed in FIGS. 18-24 are measured using a taste testing panel of 10 trained panelists rating a sample of the product in duplicate for each evaluated sensed characteristic on a scale of 0 to 15, with 0 indicating a sensed characteristic was not detected and increasing numbers representing an increasing perception of the sensed characteristic. The average measured results from the panel, including two evaluations of each sample of the product per panelist, are reported in FIGS. 18-24.

Additionally, for comparison, a control package (i.e., package used for Gamesa Marias brand cookies and labeled with a "C" in FIGS. 18-24) was also tested in duplicate after being stored under the same specified storage conditions and for the same specified time as the improved resealable package. As with the product in the improved resealable package, the product inside the control package was removed from storage and removed from the control package and various organoleptic properties listed in FIGS. 18-24 were measured using the trained taste testing panel.

The average measured results from the panel are reported in FIGS. 18-24. The organoleptic property includes an asterisk (*) in FIGS. 18-24 wherein an average measurement for an organoleptic property has a 95% confidence level as measured using ANOVA (Analysis of Variance) in conjunction with Tukey's HSD (honest significant difference test) with the significance level $\alpha$=0.05. As an example, in FIG. 1, the Toasted Aroma data is marked with an "asterisk." This means that at least one of the measured averages for this organoleptic property showed a significant difference from other measured averages for this property with a 95% confidence level.

The specific values associated with the 95% confidence level are also marked with an asterisk in Tables 1-7 below. As an example, in Table 1, the Toasted Aroma average measured value for the control package after 10 weeks in storage is marked with an asterisk. In other words, the average measured Toasted Aroma for the control package after 10 weeks in storage is significantly different with a 95% confidence level relative to other average measured values for the Toasted Aroma. To put it more generally, an average value measuring an organoleptic property is the average of a set of all reported values measuring a package type after a specified storage time. Accordingly, given an asterisk-marked average value for an organoleptic property, the value has a significant difference with a 95% confidence level relative to the other reported average values measuring the organoleptic property (e.g., average reported values associated with a different package type or the same package type and a different specified storage time).

The average measured values reported by the taste panel for each sample is recorded in Tables 1-7 below.

TABLE 1

Figure 18:
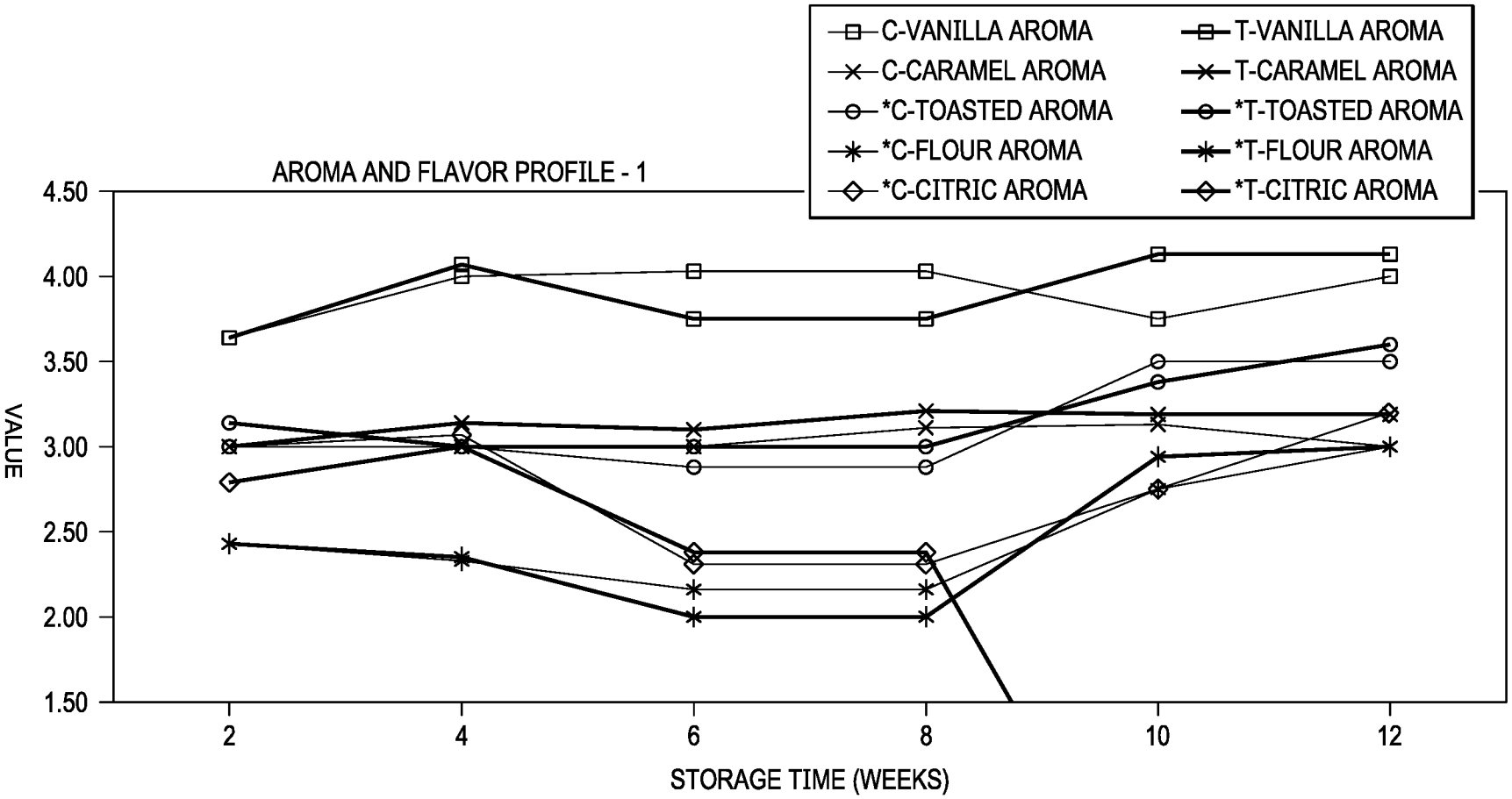
FIGS. 18-24 are charts illustrating how characteristics of a product related to aroma, flavor, effervescence sensation, appearance and texture are maintained after storage of the product for a varied number of weeks at 40° C. and 80% relative humidity in a control package that is not resealable and in a test package that is resealable.

Measured Values for FIG. 18: Aroma and Flavor Profile-1
AVERAGE MEASURED VALUE FROM TASTE TESTER PANEL

| Storage Time (Wks) | 2 | 4 | 6 | 8 | 10 | 12 |
|---|---|---|---|---|---|---|
| C-VANILLA AROMA | 3.64 | 4.00 | 4.03 | 4.03 | 3.75 | 4.00 |
| T-VANILLA AROMA | 3.64 | 4.07 | 3.75 | 3.75 | 4.13 | 4.13 |

TABLE 1-continued

Measured Values for FIG. 18: Aroma and Flavor Profile-1
AVERAGE MEASURED VALUE FROM TASTE TESTER PANEL

| Storage Time (Wks) | 2 | 4 | 6 | 8 | 10 | 12 |
|---|---|---|---|---|---|---|
| C-CARAMEL AROMA | 3.00 | 3.00 | 3.00 | 3.11 | 3.13 | 3.00 |
| T-CARAMEL AROMA | 3.00 | 3.14 | 3.10 | 3.21 | 3.19 | 3.19 |
| *C-TOASTED AROMA | 3.00 | 3.00 | 2.88 | 2.88 | *3.50 | *3.50 |
| *T-TOASTED AROMA | 3.14 | 3.00 | 3.00 | 3.00 | *3.38 | *3.60 |
| *C-FLOUR AROMA | 2.43 | 2.33 | 2.16 | 2.16 | *2.75 | *3.00 |
| *T-FLOUR AROMA | 2.43 | 2.35 | 2.00 | 2.00 | *2.94 | *3.00 |
| *C-CITRIC AROMA | 3.00 | 3.07 | 2.31 | 2.31 | *2.75 | *3.20 |
| *T-CITRIC AROMA | 2.79 | 3.00 | 2.38 | 2.38 | *0.00 | *0.00 |

TABLE 2

Figure 19:
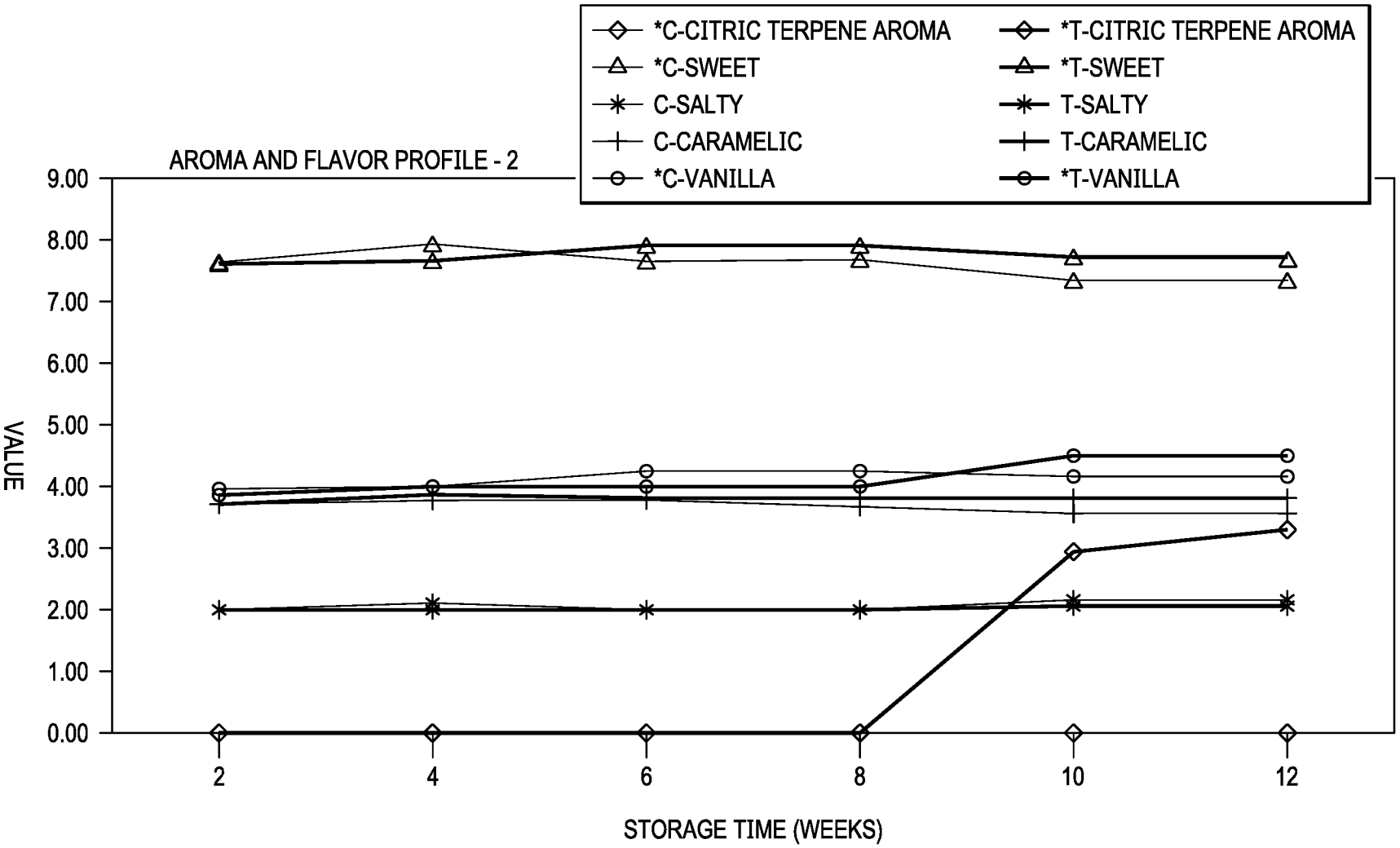

Measured Values for FIG. 19: Aroma and Flavor Profile-2
AVERAGE MEASURED VALUE FROM TASTE TESTER PANEL

| Storage Time (Wks) | 2 | 4 | 6 | 8 | 10 | 12 |
|---|---|---|---|---|---|---|
| *C-CITRIC TERPENE AROMA | 0.00 | 0.00 | 0.00 | 0.00 | *0.00 | *0.00 |
| *T-CITRIC TERPENE AROMA | 0.00 | 0.00 | 0.00 | 0.00 | *2.94 | *3.30 |
| *C-SWEET | 7.64 | 7.93 | 7.65 | 7.68 | *7.34 | *7.34 |
| *T-SWEET | 7.61 | 7.66 | 7.91 | 7.91 | 7.72 | 7.72 |
| C-SALTY | 2.00 | 2.11 | 2.00 | 2.00 | 2.16 | 2.16 |
| T-SALTY | 2.00 | 2.00 | 2.00 | 2.00 | 2.06 | 2.06 |
| C-CARAMELIC | 3.71 | 3.77 | 3.78 | 3.67 | 3.56 | 3.56 |
| T-CARAMELIC | 3.71 | 3.87 | 3.81 | 3.81 | 3.81 | 3.81 |
| *C-VANILLA | 3.96 | 4.00 | 4.25 | 4.25 | 4.16 | 4.16 |
| *T-VANILLA | 3.86 | 4.00 | 4.00 | 4.00 | *4.50 | *4.50 |

TABLE 3

Figure 20:
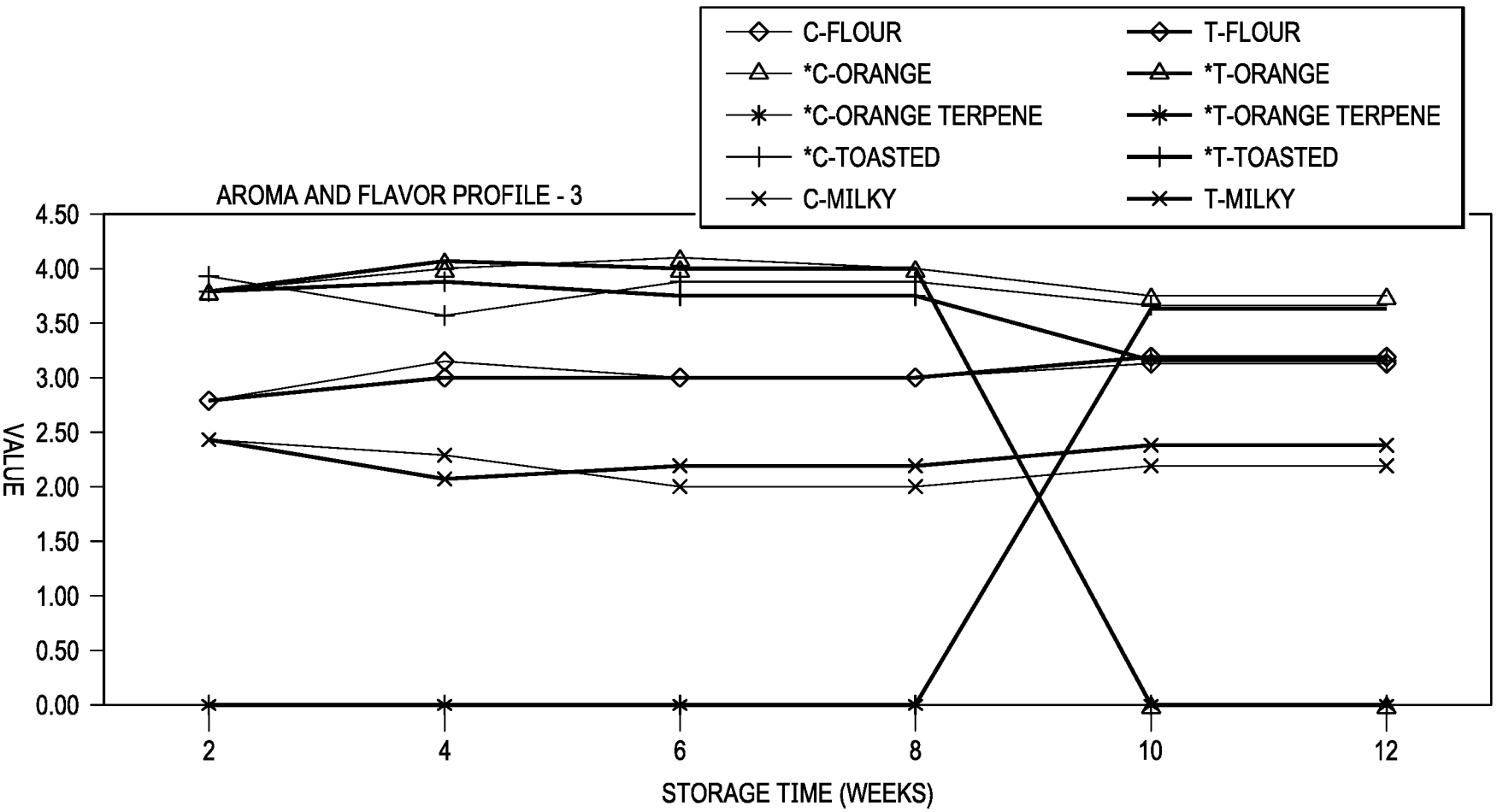

Measured Values for FIG. 20: Aroma and Flavor Profile-3
AVERAGE MEASURED VALUE FROM TASTE TESTER PANEL

| Storage Time (Wks) | 2 | 4 | 6 | 8 | 10 | 12 |
|---|---|---|---|---|---|---|
| C-FLOUR | 2.79 | 3.15 | 3.00 | 3.00 | 3.13 | 3.13 |
| T-FLOUR | 2.79 | 3.00 | 3.00 | 3.00 | 3.19 | 3.19 |
| *C-ORANGE | 3.79 | 4.00 | 4.10 | 4.00 | *3.75 | *3.75 |
| *T-ORANGE | 3.79 | 4.07 | 4.00 | 4.00 | *0.00 | *0.00 |
| *C-ORANGE TERPENE | 0.00 | 0.00 | 0.00 | 0.00 | *0.00 | *0.00 |
| *T-ORANGE TERPENE | 0.00 | 0.00 | 0.00 | 0.00 | *3.63 | *3.63 |
| *C-TOASTED | 3.93 | 3.57 | 3.88 | 3.88 | *3.66 | *3.66 |
| *T-TOASTED | 3.79 | 3.88 | 3.75 | 3.75 | *3.16 | *3.16 |
| C-MILKY | 2.43 | 2.29 | 2.00 | 2.00 | 2.19 | 2.19 |
| T-MILKY | 2.43 | 2.07 | 2.19 | 2.19 | 2.38 | 2.38 |

TABLE 4

Figure 21:
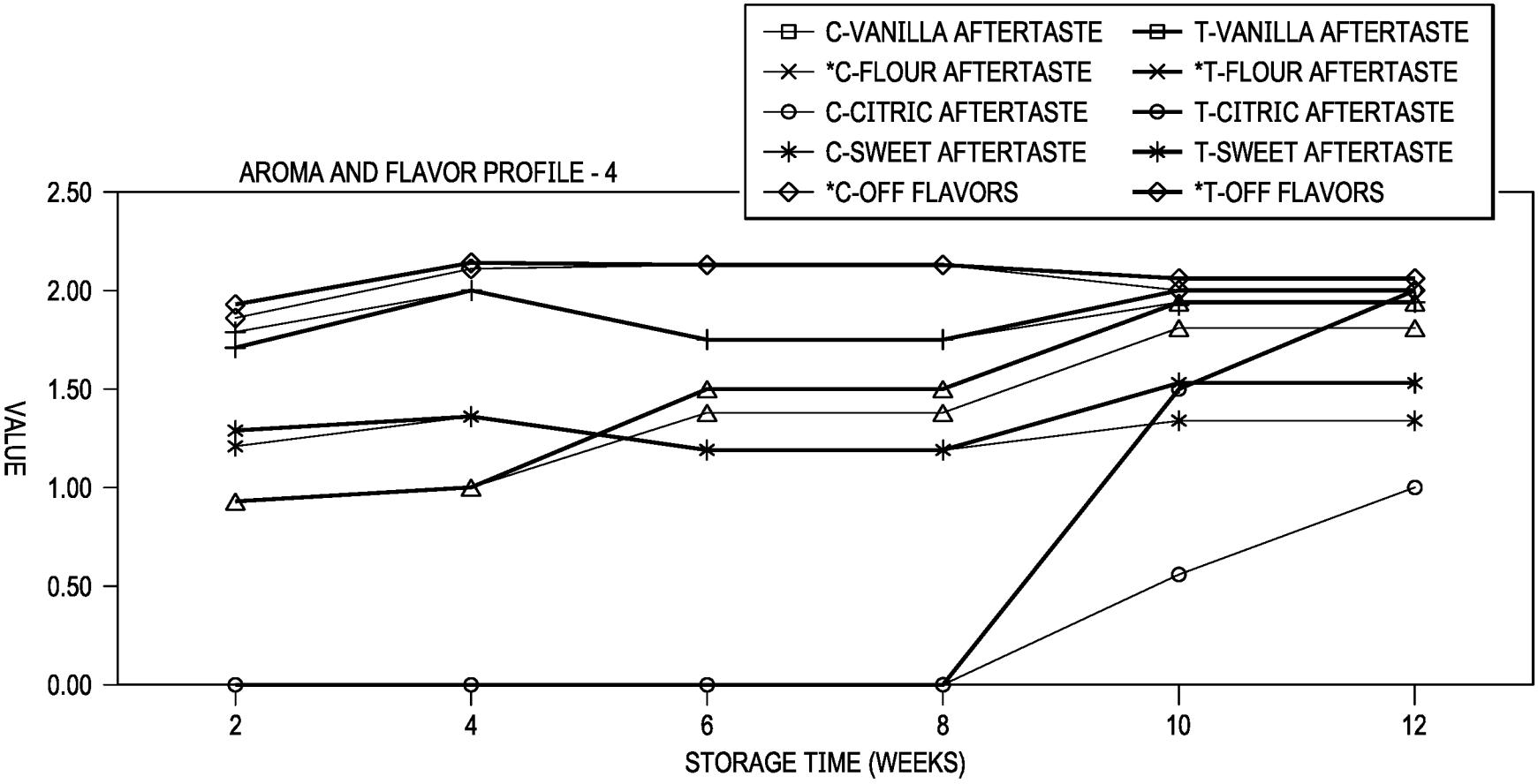

Measured Values for FIG. 21: Aroma and Flavor Profile-4
AVERAGE MEASURED VALUE FROM TASTE TESTER PANEL

| Storage Time (Wks) | 2 | 4 | 6 | 8 | 10 | 12 |
|---|---|---|---|---|---|---|
| C-VANILLA AFTERTASTE | 1.86 | 2.11 | 2.13 | 2.13 | 2.00 | 2.00 |
| T-VANILLA AFTERTASTE | 1.93 | 2.14 | 2.13 | 2.13 | 2.06 | 2.06 |
| *C-FLOUR AFTERTASTE | 0.93 | 1.00 | 1.38 | 1.38 | *1.81 | *1.81 |
| *T-FLOUR AFTERTASTE | 0.93 | 1.00 | *1.50 | *1.50 | *1.94 | *1.94 |
| C-CITRIC AFTERTASTE | 1.21 | 1.36 | 1.19 | 1.19 | 1.34 | 1.34 |
| T-CITRIC AFTERTASTE | 1.29 | 1.36 | 1.19 | 1.19 | 1.53 | 1.53 |

TABLE 4-continued

Measured Values for FIG. 21: Aroma and Flavor Profile-4
AVERAGE MEASURED VALUE FROM TASTE TESTER PANEL

| Storage Time (Wks) | 2 | 4 | 6 | 8 | 10 | 12 |
|---|---|---|---|---|---|---|
| C-SWEET AFTERTASTE | 1.79 | 2.00 | 1.75 | 1.75 | 1.94 | 1.94 |
| T-SWEET AFTERTASTE | 1.71 | 2.00 | 1.75 | 1.75 | 2.00 | 2.00 |
| *C-OFF FLAVORS | 0.00 | 0.00 | 0.00 | 0.00 | *0.56 | *1.00 |
| *T-OFF FLAVORS | 0.00 | 0.00 | 0.00 | 0.00 | *1.50 | *2.00 |

TABLE 5

Figure 22:
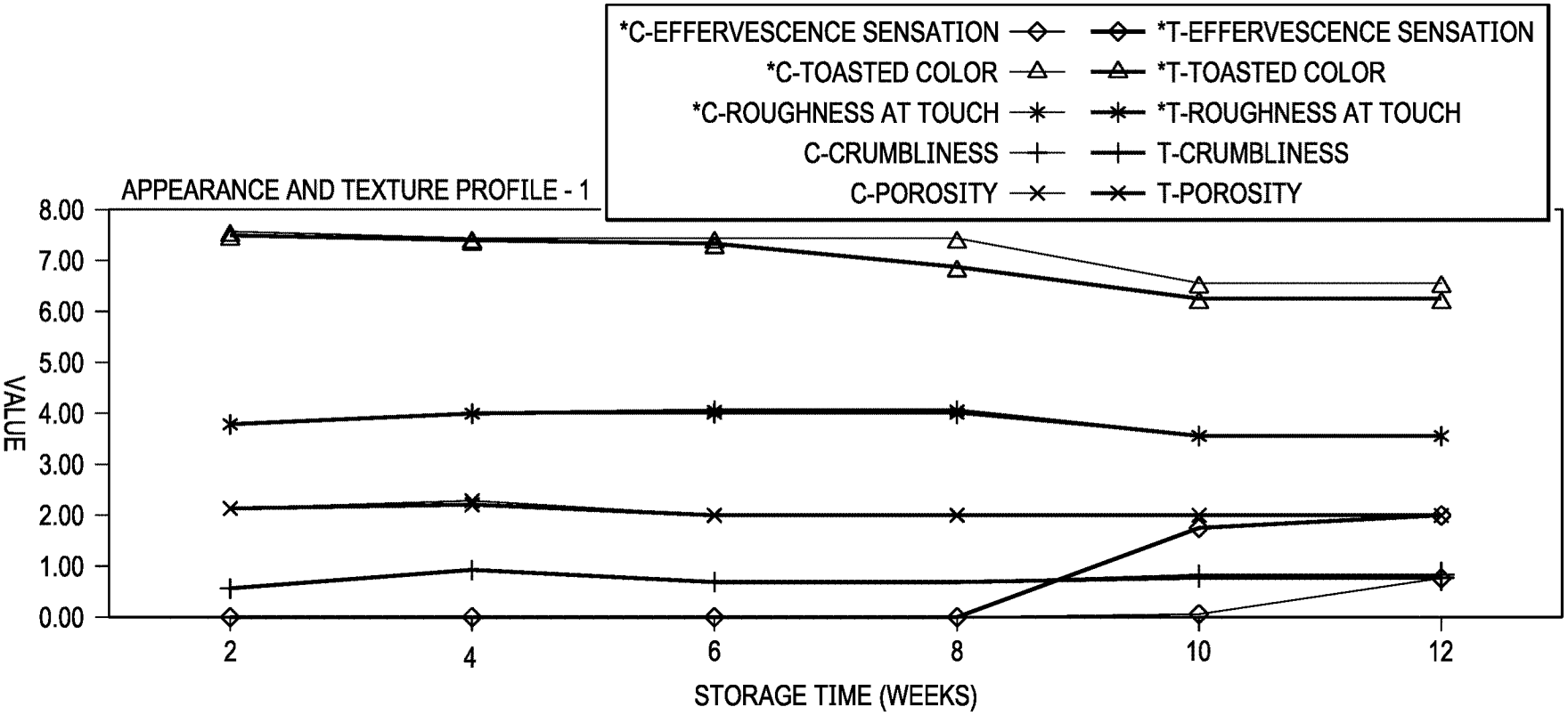

Measured Values for FIG. 22: Appearance and Texture Profile-1
AVERAGE MEASURED VALUE FROM TASTE TESTER PANEL

| Storage Time (Wks) | 2 | 4 | 6 | 8 | 10 | 12 |
|---|---|---|---|---|---|---|
| *C-EFFERVESCENCE SENSATION | 0.00 | 0.00 | 0.00 | 0.00 | 0.06 | *0.77 |
| *T-EFFERVESCENCE SENSATION | 0.00 | 0.00 | 0.00 | 0.00 | *1.75 | *2.00 |
| *C-TOASTED COLOR | 7.57 | 7.44 | 7.44 | 7.44 | *6.56 | *6.56 |
| *T-TOASTED COLOR | 7.50 | 7.40 | 7.33 | *6.88 | *6.25 | *6.25 |
| *C-ROUGHNESS AT TOUCH | 3.79 | 4.00 | 4.06 | 4.06 | *3.56 | *3.56 |
| *T-ROUGHNESS AT TOUCH | 3.79 | 4.00 | 4.00 | 4.00 | *3.56 | *3.56 |
| C-CRUMBLINESS | 0.57 | 0.93 | 0.69 | 0.69 | 0.84 | 0.84 |
| T-CRUMBLINESS | 0.57 | 0.93 | 0.69 | 0.69 | 0.78 | 0.78 |
| C-POROSITY | 2.14 | 2.21 | 2.00 | 2.00 | 2.00 | 2.00 |
| T-POROSITY | 2.14 | 2.29 | 2.00 | 2.00 | 2.00 | 2.00 |

TABLE 6

Figure 23:
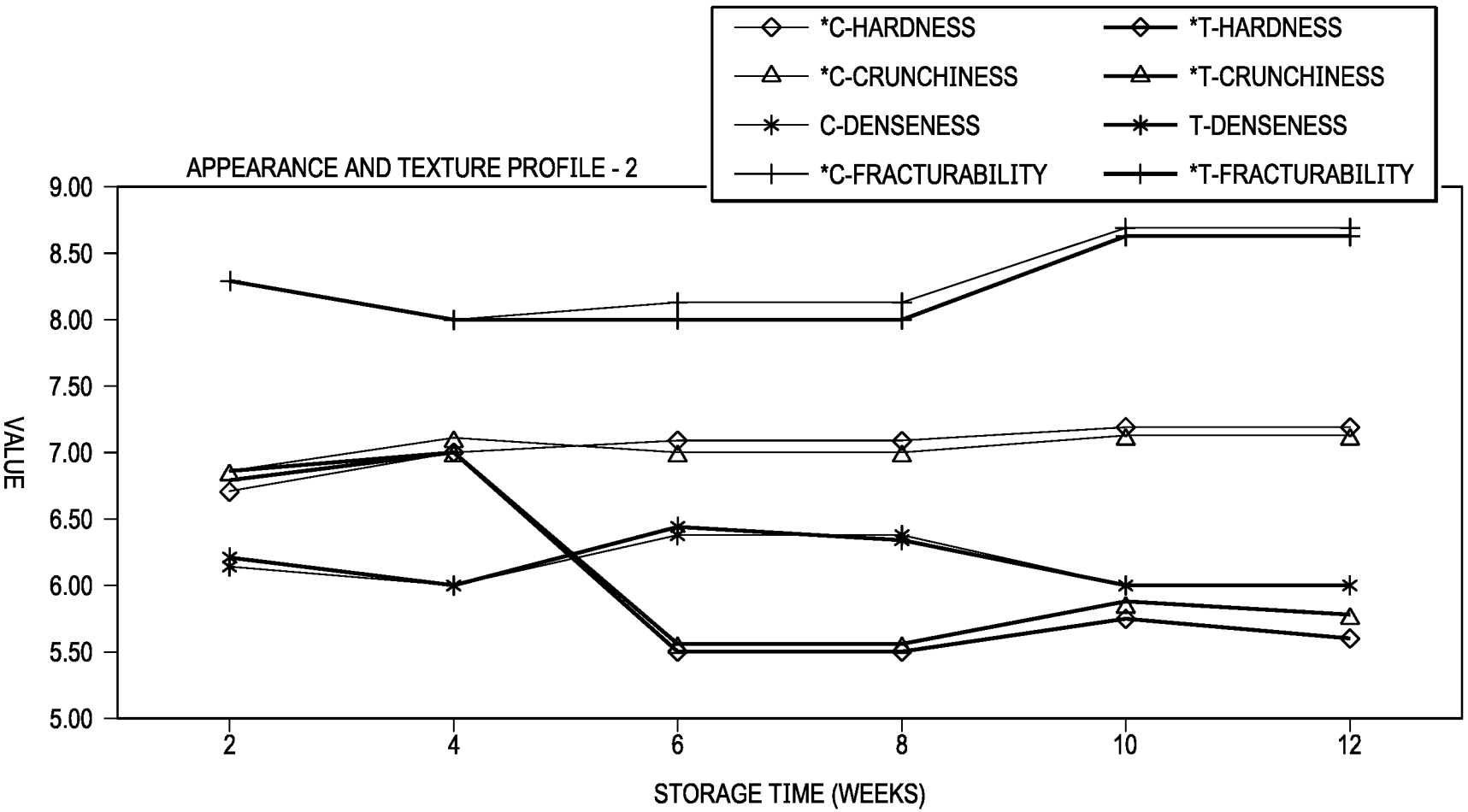

Measured Values for FIG. 23: Appearance and Texture Profile-2
AVERAGE MEASURED VALUE FROM TASTE TESTER PANEL

| Storage Time (Wks) | 2 | 4 | 6 | 8 | 10 | 12 |
|---|---|---|---|---|---|---|
| *C-HARDNESS | 6.71 | 7.00 | 7.09 | 7.09 | 7.19 | 7.19 |
| *T-HARDNESS | 6.79 | 7.00 | *5.50 | *5.50 | *5.75 | *5.60 |
| *C-CRUNCHINESS | 6.86 | 7.11 | 7.00 | 7.00 | 7.13 | 7.13 |
| *T-CRUNCHINESS | 6.86 | 7.00 | *5.56 | *5.56 | *5.88 | *5.78 |
| C-DENSENESS | 6.14 | 6.00 | 6.38 | 6.38 | 6.00 | 6.00 |
| T-DENSENESS | 6.21 | 6.00 | 6.44 | 6.34 | 6.00 | 6.00 |
| *C-FRACTURABILITY | 8.29 | 8.00 | 8.13 | 8.13 | *8.69 | *8.69 |
| *T-FRACTURABILITY | 8.29 | 8.00 | 8.00 | 8.00 | *8.63 | *8.63 |

TABLE 7

Figure 24:
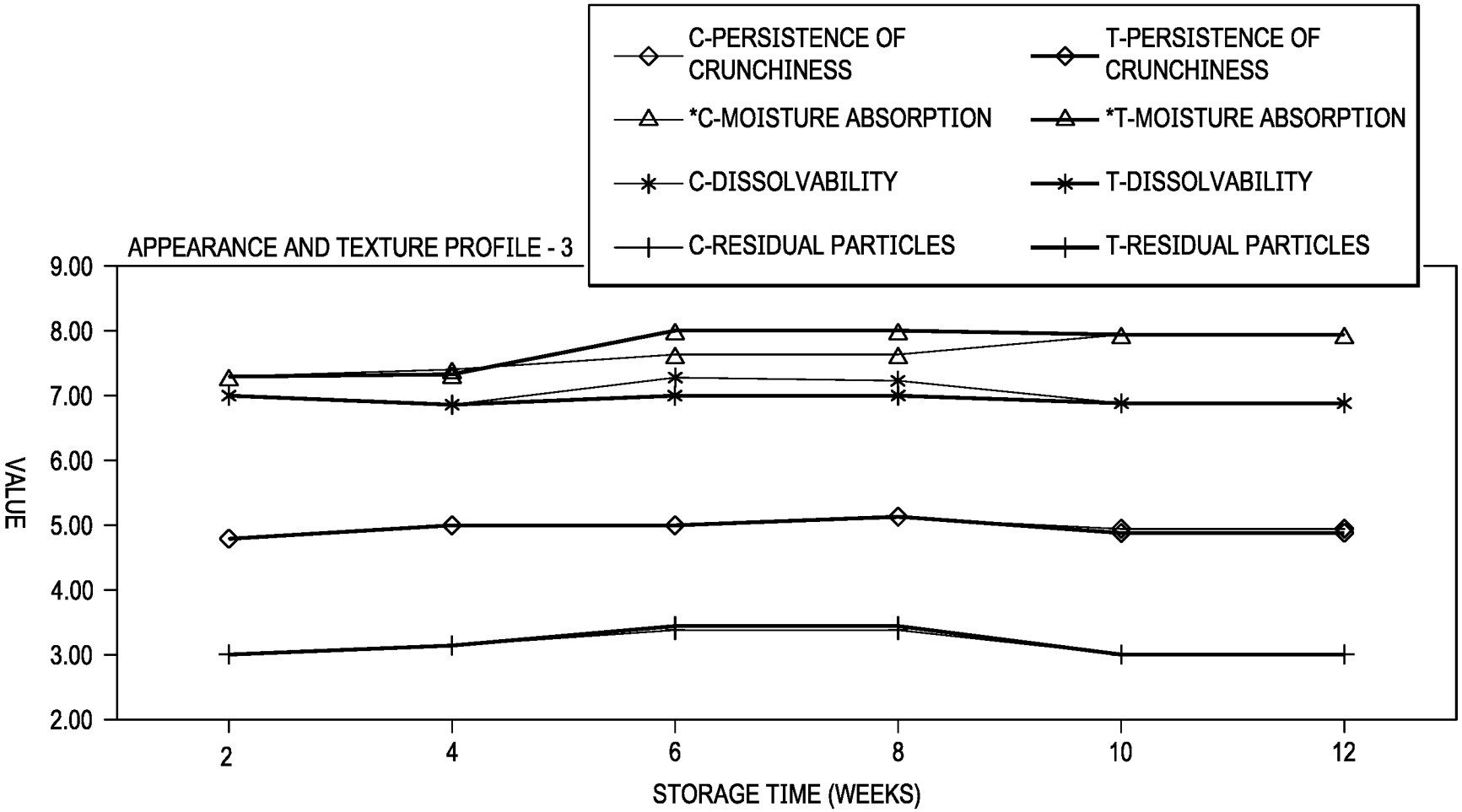

Measured Values for FIG. 24: Appearance and Texture Profile-3
AVERAGE MEASURED VALUE FROM TASTE TESTER PANEL

| Storage Time (Weeks) | 2 | 4 | 6 | 8 | 10 | 12 |
|---|---|---|---|---|---|---|
| C-PERSISTENCE OF CRUNCHINESS | 4.79 | 5.00 | 5.00 | 5.11 | 4.94 | 4.94 |
| T-PERSISTENCE OF CRUNCHINESS | 4.79 | 5.00 | 5.00 | 5.13 | 4.88 | 4.88 |
| *C-MOISTURE ABSORPTION | 7.29 | 7.40 | 7.63 | 7.63 | *7.94 | *7.94 |
| *T-MOISTURE ABSORPTION | 7.29 | 7.33 | *8.00 | *8.00 | *7.94 | *7.94 |
| C-DISSOLVABILITY | 7.00 | 6.86 | 7.28 | 7.23 | 6.88 | 6.88 |
| T-DISSOLVABILITY | 7.00 | 6.86 | 7.00 | 7.00 | 6.88 | 6.88 |
| C-RESIDUAL PARTICLES | 3.00 | 3.14 | 3.38 | 3.38 | 3.00 | 3.00 |

TABLE 7-continued

Measured Values for FIG. 24: Appearance and Texture Profile-3
AVERAGE MEASURED VALUE FROM TASTE TESTER PANEL

| Storage Time (Weeks) | 2 | 4 | 6 | 8 | 10 | 12 |
|---|---|---|---|---|---|---|
| T-RESIDUAL PARTICLES | 3.00 | 3.14 | 3.44 | 3.44 | 3.00 | 3.00 |

As illustrated, FIGS. 18-24 provide data on both a product stored in control package that is not resealable and a test package that is equivalent to the control package, except that the test package comprises cold seal adhesive on a reseal region located inside a primary seal region of the package wrapper. As can be seen in FIGS. 18-24, at the end of the specified time, for some embodiments of an improved resealable package (e.g., the test package), the product stored in the package comprises an organoleptic profile with at least one characteristic that is at least equal to, equal to within +/−50, 40, 30, 25, 20, 15, 10, 5, 4, 3, 2, or 1% of, equal to, or no more than at least one characteristic of the control package at the end of the specified time. In some embodiments, the at least one characteristic is a set of characteristics selected from one or a plurality of the characteristics listed in FIGS. 18-24 or a combination thereof.

Moreover, as described in the Additional Embodiment section herein, some embodiments of a wrapper or a package made from the wrapper can include additional or alternative characteristics, which, in some cases, can significantly impact barrier properties.

Depending on how a cold seal is applied to a wrapper, the barrier properties of a package comprising cold seal adhesive can be substantially similar to those of an identical package without cold seal adhesive. Nonetheless, if an appropriate cold seal adhesive is not used, it can result in undesirable impacts on the quality of a product contained within the package. For example, a component of the cold seal adhesive, could potentially impact the organoleptic properties of a product or the shelf-life of a product.

Accordingly, in some embodiments the cold seal adhesive 0110 has an overall migration rate to a product in contact with the cold seal adhesive, wherein the cold seal adhesive is selected to minimize the overall migration rate of the cold seal adhesive to the product and/or to avoid or minimize effects on the product's organoleptic properties, for example, smell, taste, color and texture. Similarly, in some embodiments, the cold seal adhesive 0110 comprises a solvent, and the solvent is selected to minimize the overall migration rate of the solvent to a product in contact with the cold seal adhesive and to avoid or minimize effects of the solvent on the product's organoleptic properties, for example, smell, taste, color and texture.

Although it can be useful to reduce a migration rate of the cold seal adhesive, it can also be useful to mask any off-flavors that might be caused by a cold-seal adhesive. Accordingly, in some embodiments, the cold seal adhesive 0110 comprises an additive to reduce or avoid a smell, taste or both associated with the cold seal adhesive 0110. Moreover, in some embodiments, the cold seal adhesive 0110 comprises an additive to reduce or avoid transferring a smell, taste or both from the cold seal adhesive 0110 to the product 0206. In some embodiments the cold seal adhesive is a water-based emulsion. An example of a cold seal adhesive that can be used in some embodiments of improved packaging materials as described herein is COSEAL™ 30061A cold seal adhesive, available from DowDuPont of Michigan, USA.

Advantageously, precursors 0100 described herein can be compatible with existing product packaging lines (e.g., manufacturing lines for making a package 0200 that contains a product 0206), whether publicly known or not. For example, the precursor can be compatible with existing product packaging lines in the sense that the addition of the reseal region 0106 (e.g., cold seal adhesive 0110) does not require modifications of a process used to make a package that contains a product, does not require new equipment, only requires modifications that can be made without new equipment, or a combination thereof. As a further example, a precursor 0100 described herein can be configured for compatibility with an existing form, fill and seal machine 0600.

With reference again to FIG. 2, an embodiment of an improved resealable package 0200 for a product 0206 will now be described. The package 0200 comprises a precursor 0100 as described herein, a product-facing surface 0204, at least one primary seal 0210, and a product containment surface 0202. The wrapper 0102 of the precursor is adhered to itself along at least one primary seal region 0104 of the wrapper 0102 to provide at least one primary seal 0210 for the package 0200, thereby forming a product containment space 0212 within the package 0200. As illustrated, the product containment space 0212 within the package 0200 is bound by the product-facing surface 0204 of the package 0200 and the at least one primary seal 0210 of the package 0200.

In some embodiments, the product-facing surface 0204 of the package 0200 comprises the reseal region 0106 of the wrapper 0102, cold-seal-adhesive-coated region 0108 of the wrapper 0102, cold seal adhesive 0110, or a combination thereof.

As illustrated in FIG. 2, in some embodiments, the first end seal region 0124 of the wrapper 0102 can provide (e.g., be formed into, be adhered to itself to provide, or a combination thereof) a first end seal 0214 for the package 0200. Similarly, in some embodiments, the second end seal region 0126 of the wrapper 0102 can provide (e.g., be formed into, be adhered to itself to provide, or a combination thereof) a second end seal 0216 for the package 0200.

With reference again to FIG. 2, in some embodiments, the first longitudinal seal region 0128 and the second longitudinal seal region 0130 of the wrapper 0102 are joined (e.g., mutually adhered) to provide a longitudinal seal 0900 for the package 0200.

With reference to FIG. 5, an example of an assembly 0500 is illustrated. The assembly 0500 comprises a package 0200 as described herein and a product 0206 that is contained by the package 0200.

In some embodiments, the assembly 0500 comprises a product 0206 that is crumbly and/or powdery. Additionally, in some embodiments, the cold seal adhesive 0110 used in the assembly 0500 is effective to provide a seal upon being pressed against itself if up to 10, 20, 30, 40, 50, 60 or 70% of the surface area of the cold seal adhesive 0110 on the reseal region 0106 of the wrapper 0102 if covered with particles (e.g., crumbs, powder, etc.) of the product 0206.

In some embodiments, a product 0206 contained by a package 0200 described herein can be a perishable product 0206 (e.g., an edible product 0206 or product intended for human consumption). Additionally, the product 0206 can be divided or divisible into multiple discrete portions, which can be called product units 0208. In some circumstances, every product unit 0208 in a package is not consumed in a single use of the product 0206. Accordingly, it can be advantageous to reseal a package that contains the product 0206.

Although many different types of products are compatible with a resealable package as described herein, some products are better suited for use with the package than others. Accordingly, in some embodiments, the product 0206 contained by a package has a characteristic selected from the following characteristics: (i) the product 0206 is not so oily that reseal is prevented or is not oily in the sense that drops or pools of unabsorbed oil are present at the surface of the product 0206, (ii) the product 0206 does not comprise a filling that is exposed at the surface of the product 0206 (e.g., to an extent that reseal is prevented or to an extent that drops or pools of filling are present at the surface of the product 0206), (iii) the product 0206 does not comprise chocolate chips on a surface of the product 0206 (e.g., to an extent that reseal is prevented or does not comprise chocolate chips on the surface at all), (iv) the product 0206 comprises crumbles on a surface of the product 0206 and the crumbles cover no more than 5, 10, 15, 20, 30, 40, 50% of the surface of the product 0206 by area, (v) the product 0206 comprises a powder on a surface of the product 0206 and the powder covers no more than 5, 10, 15, 20, 30, 40, 50% of the surface of the product 0206 by area, and (vi) a combination thereof.

In addition to providing resealability, it can be useful for package to have initial barrier properties associated with a primary seal that are adequate to preserve a product for its specified shelf-life. Accordingly, these or other related properties are described herein in the Additional Embodiments section. Additionally, in some embodiments, a package 0200 described herein can remain safe for consumption and/or maintain desired organoleptic properties (e.g., one or any set of properties described herein) for a shelf life of at least 36 weeks in air at 23° C. and 60% relative humidity. Furthermore, in some embodiments, the package 0200 can remain safe for consumption and/or maintain desired organoleptic properties (e.g., one or any set of properties described herein) a shelf life of at least 36 weeks in air at 38° C. and 90% relative humidity.

In some embodiments, the inventor expects that a package as described herein will be used in conjunction products intended to be consumed by humans or other animals. Accordingly, in some embodiments, the wrapper 0102, cold seal adhesive 0110, precursor 0100, package 0200 or combination thereof is safe for use with (e.g., safe for contact with) a consumable (e.g., edible) product 0206 or product intended for human consumption. As an example, safe can be defined according to the laws and/or specifications of a governmental agency responsible for permitting food, for example, the FDA in the United States. If the package will contain a product that is to be sold or consumed in another country, safe can be defined in accordance with the laws and/or specifications applicable in the country where the product will be sold or consumed.

In some embodiments, the wrapper 0102, cold seal adhesive 0110, precursor 0100, package 0200 or combination thereof comprises no lead, no more than an undetectable amount of lead (e.g., no more than 10 mg/kg lead), no cadmium, no more than an undetectable amount of Cadmium (e.g., no more than 5 mg/kg Cadmium), no mercury, no more than an undetectable amount of mercury (e.g., no more than 1 mg/kg mercury), no Chromium, no more than an undetectable amount of Chromium (e.g., no more than 10 mg/kg Chromium), no Chromium IV, no more than an undetectable amount of Chromium IV (e.g., no more than 10 mg/kg of Chromium IV from compounds with Chromium in a +4 oxidation state), or a combination thereof.

Figure 14:
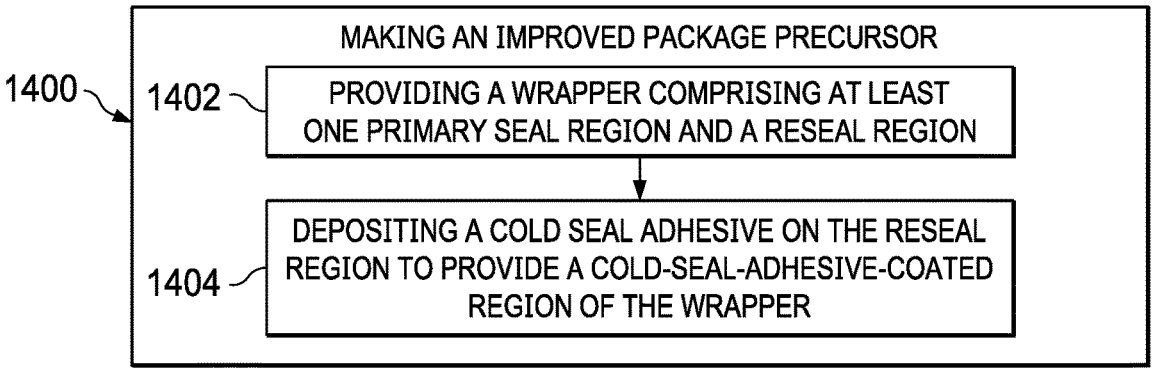
FIG. 14 is a schematic flow chart illustrating a method for making an improved package precursor.

Turning now to FIG. 1, FIG. 2 and FIG. 14, one embodiment of a method 1400 for making an improved package precursor 0100 for an improved resealable package 0200 is illustrated. The method comprises several steps. A first step comprises providing 1402 a wrapper 0102 comprising at least one primary seal region 0104 and a reseal region 0106. A second step comprises depositing 1404 a cold seal adhesive 0110 on the reseal region 0106 to provide a cold-seal-adhesive-coated region 0108 of the wrapper 0102. The reseal region 0106 can be configured to form at least a portion of a product containment surface 0202 of the package 0200. Additionally, the reseal region 0106 can be configured to form at least a portion of a product-facing surface 0204 of the package 0200.

Figure 15:
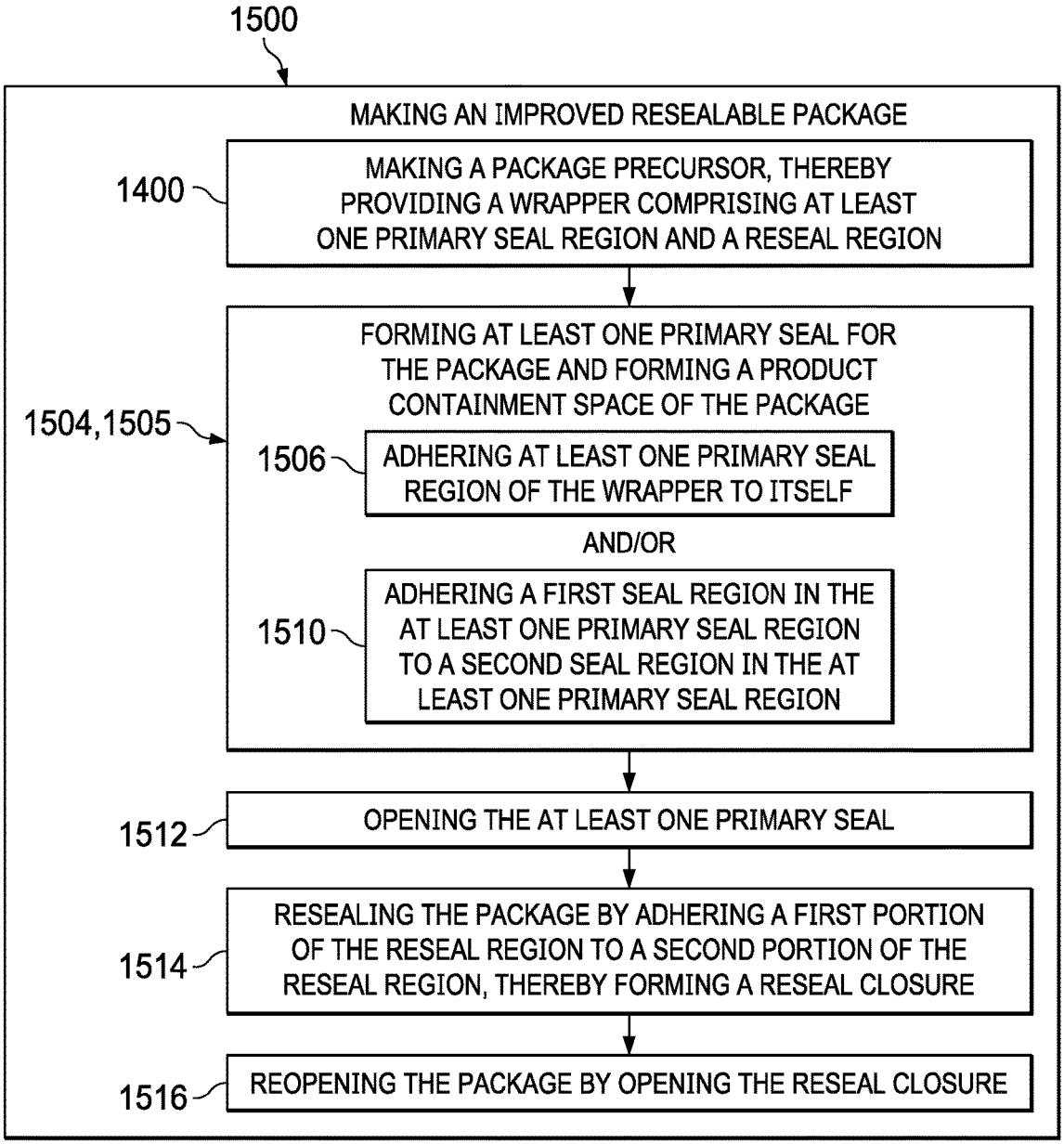
FIG. 15 is a schematic flow chart illustrating a method for making an improved resealable package.

Turning to FIG. 1, FIG. 2 and FIG. 15, one embodiment of a method 1500 for making an improved resealable package 0200 is illustrated. The method comprises several steps. A first step comprises making 1400 a precursor 0100, for example, as described herein. A second step comprises forming 1504 at least one primary seal 0210 for the package 0200 and forming 1505 a product containment space 0212 of the package 0200. In some embodiments, the forming 1504, 1505 step comprises adhering 1506 at least one primary seal region 0104 of the wrapper 0102 to itself (e.g., first end seal region 0124 or second end seal region 0126); adhering 1510 a first seal region (e.g., the first longitudinal seal region 0128) in the at least one primary seal region 0104 to a second seal region (e.g., the second longitudinal seal region 0130) in the at least one primary seal region 0104; or a combination thereof.

With reference again to FIG. 15, in some embodiments, the method comprises a third step of opening 1512 the at least one primary seal 0210 (e.g., breaking, rupturing, or permanently opening at least one primary seal 0210, or a combination thereof).

With further reference to FIG. 15 and FIG. 7, in some embodiments, the method comprises a fourth step of resealing 1514 the package 0200 by adhering a first portion 0702 of the reseal region 0106 to a second portion 0704 of the reseal region 0106 (e.g., by pressing the first portion of the reseal region 0106 against the second portion of the reseal region 0106, for example, by folding or twisting the reseal region 0106, by using the cold seal adhesive 0110, or a combination thereof), thereby forming a reseal closure 0700.

In some embodiments, a fourth step comprises resealing 1514 the package 0200 by adhering a first portion 0702 of the reseal region 0106 to a second portion 0704 of the reseal region 0106 thereby forming a reseal closure 0700.

In some embodiments, a fifth step comprises reopening 1516 the package 0200 by opening the reseal closure 0700.

In some embodiments, the method comprises repeating the resealing 1514 and reopening 1516 a plurality of times. Furthermore, in some embodiments, for a subsequent resealing step or for each subsequent resealing step, a first portion 0702 of the reseal region 0106 as adhered to form a subsequent reseal closure 0700, a second portion 0704 of the reseal region 0106 as adhered to form a subsequent reseal closure 0700, or a combination thereof, includes a portion of the reseal region 0106 that was not used to form a previous reseal closure 0700. In some embodiments, the plurality of times that resealing 1514 and reopening 1516 occurs is equal to the number of servings listed on a label of the package 0200 minus 1. Accordingly, in some embodiments, the plurality of times is equal to at least 2, 3, 4, 5, 6, 7, 8, 9, or 10 times.

Figure 17:
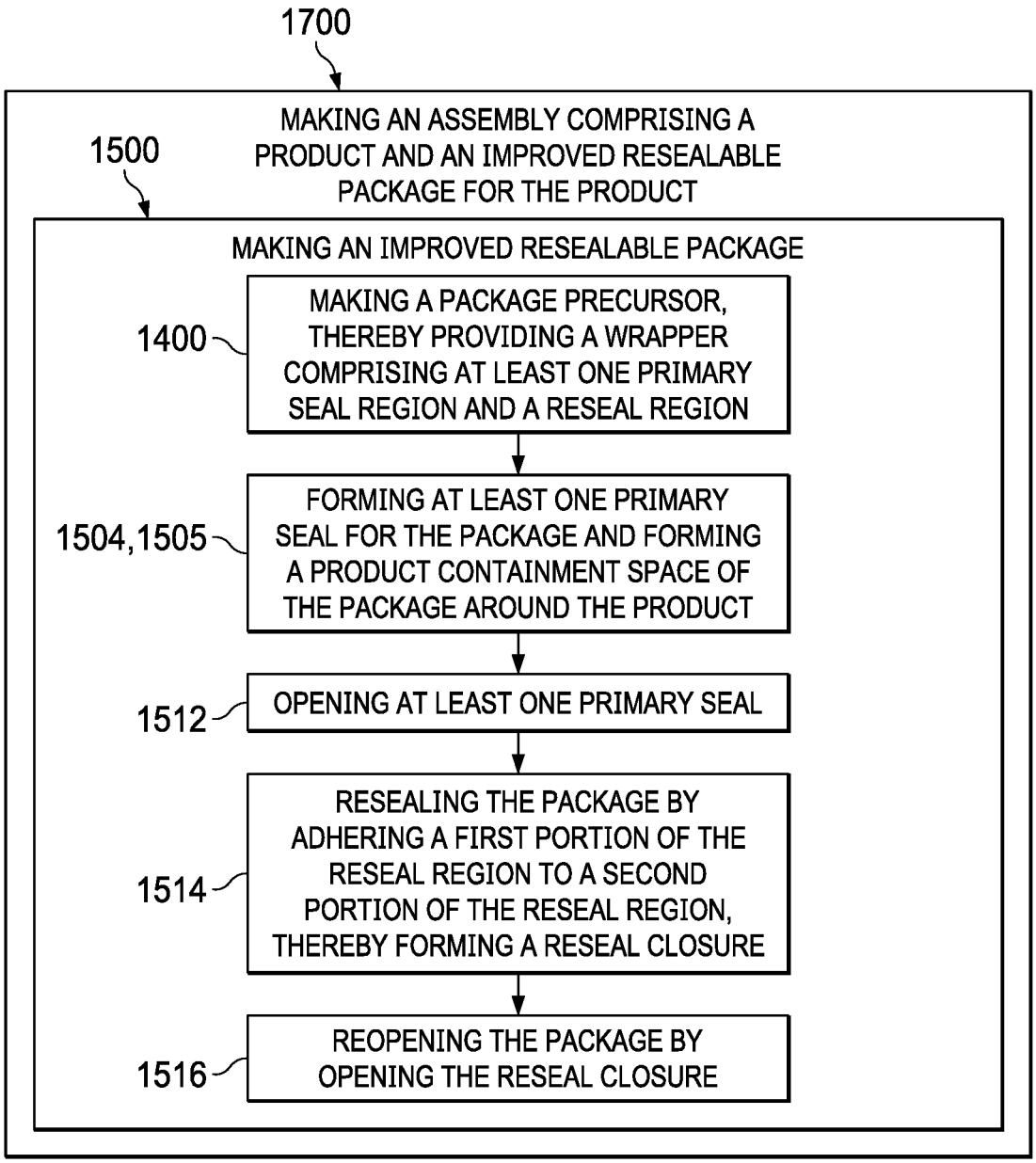
FIG. 17 is a schematic flow chart illustrating a method for making an assembly comprising a product and an improved resealable package for the product.

With reference again to FIG. 17, in some embodiments, the reseal closure 0700 is sufficiently sealed so that a package 0200 resealed using the reseal closure 0700 has no visibly apparent openings in the package 0200. In some embodiments, the reseal closure 0700 is sufficiently sealed so that a package 0200 resealed using the reseal closure 0700 has no openings in the package 0200 with a size greater than 1, 0.9, 0.8, 0.7, 0.6, 0.5, 0.4, 0.3, 0.2, 0.1, 0.05, 0.04, 0.03, 0.02 or 0.01 mm, where the size is measured as the longest distance between any two points on a perimeter of the opening.

With reference to FIG. 15 and FIG. 6, in some embodiments, the method 1500 for making the improved resealable package 0200 comprises: feeding the precursor 0100 comprising the wrapper 0102 to a form, fill and seal machine 0600 at a linear rate of at least 20, 30, 35, 38, 40, 45, 50, 55 m/min, no more than 30, 35, 38, 40, 45, 50, 55, or 60 m/min, or a combination thereof; using the form, fill and seal machine 0600 to form the wrapper 0102 into a package 0200 around the product 0206; and discharging discrete packages 0200 containing the product 0206 at a linear rate of at least 20, 30, 35, 38, 40, 45, 50, 55 m/min, no more than 30, 35, 38, 40, 45, 50, 55, or 60 m/min, or a combination thereof.

With reference against to FIG. 15 and FIG. 6, in some embodiments, the method 1500 for making the improved resealable package 0200 comprises: feeding the precursor 0100 comprising the wrapper 0102 to an existing form, fill and seal machine 0600 configured to form a package 0200 from a reference precursor 0100 that is equivalent to the improved precursor 0100 except that the reference precursor 0100 does not comprise the reseal region 0106.

In some embodiments, the existing form, fill and seal machine 0600 requires no additional equipment between being used to form packages 0200 from the reference precursor 0100 and then being used to form package 0200 from the precursor 0100.

In some embodiments, controllable settings of the existing form, fill and seal machine 0600, which are used to form the package 0200 from the reference precursor 0100, undergo no more than limited modification between the time the machine is used to form packages 0200 from the reference precursor 0100 and the time the machine is used to form packages 0200 from the precursor 0100. For example, in some embodiments, the controllable settings of the form, fill and seal machine 0600 are not modified by more than 20, 15, 10, 9, 8, 7, 6, 5, 4, 3, 2 or 1% of the controllable settings used to form a package 0200 for the reference precursor 0100. Additionally, in some embodiments, the form, fill and seal machine is unmodified between being used to form packages 0200 from the reference precursor 0100 and being used to from packages 0200 from the precursor 0100.

In some embodiments, the reference precursor 0100 is equivalent to the improved precursor 0100 in the sense that a value associated with a precursor characteristic differs from a value associated with the corresponding reference precursor characteristic by no more than 20, 15, 10, 9, 8, 7, 6, 5, 4, 3, 2 or 1% of the reference precursor characteristic. Optionally, the reference precursor characteristic is selected from length, width, surface area, average thickness 0112, mass, composition or a combination thereof.

In some embodiments, a method described herein can comprise one or more additional features and/or characteristics. For example, in some embodiments, the product containment space 0212 is bound by the at least one primary seal 0210 and a product containment surface 0202 of the package 0200. Additionally, in some embodiments, the product containment surface 0202 of the package 0200 comprises at least a portion of the reseal region 0106 (e.g., at least 5, 10, 15, 20, 25, 30, 35, 40, 35, 50, 55, 60, 65, 70, 75, 80, 85, 90, 95, or 100% of the reseal region 0106). Furthermore, in some embodiments, the reseal region 0106 of the wrapper 0102 forms at least a portion of a product-facing surface 0204 of the package 0200.

Figure 16:
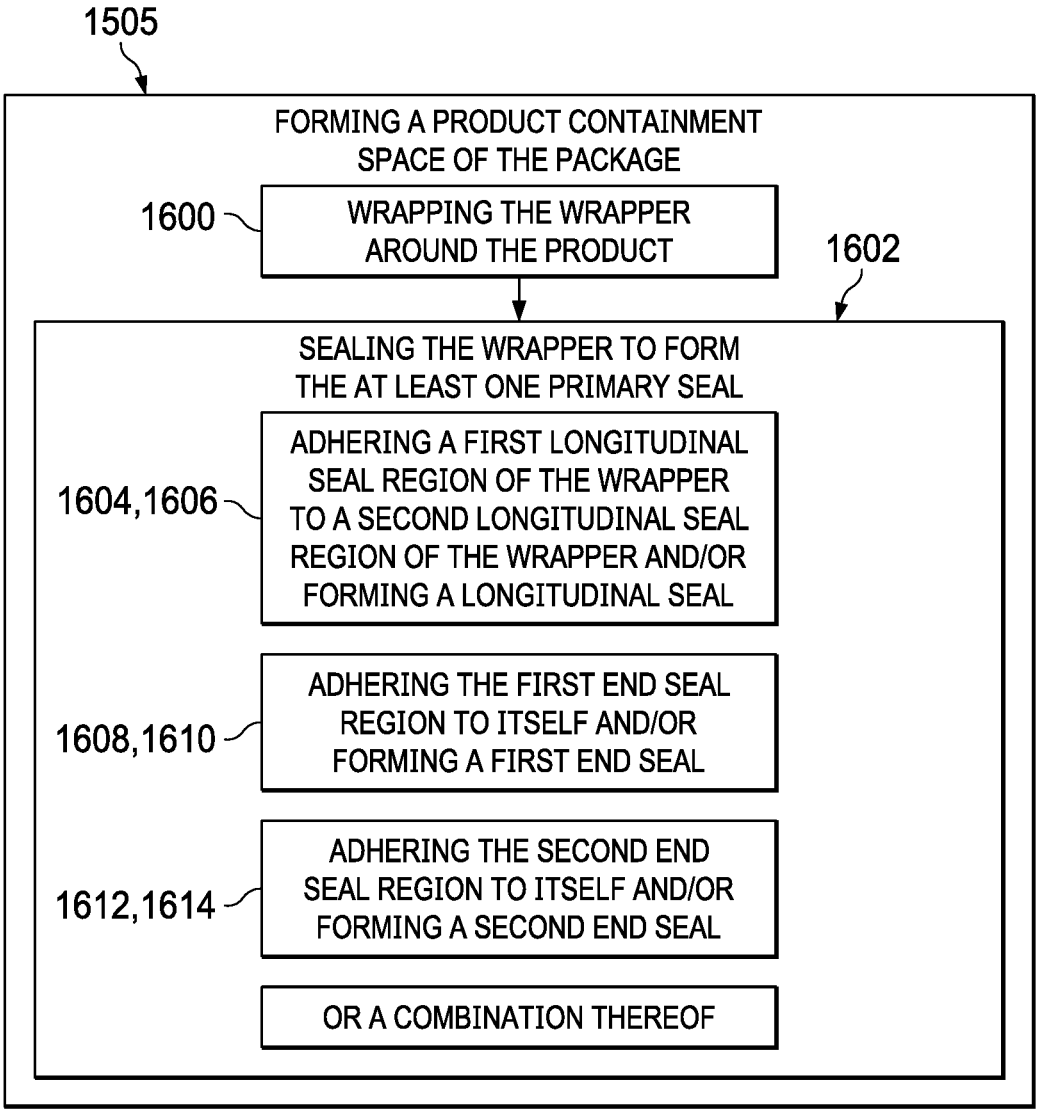
FIG. 16 is a schematic flow chart illustrating a method for forming a product containment space of a package.

With reference to FIG. 1, FIG. 15 and FIG. 16, some embodiments of a method described herein comprise the step of forming 1505 the product containment space 0212 by wrapping 1600 the wrapper 0102 around the product 0206 and sealing 1602 the wrapper 0102 to form the at least one primary seal 0210. Accordingly, a product containment space 0212 of a package 0200 made according to a method described herein can contain a product 0206.

Figure 9:
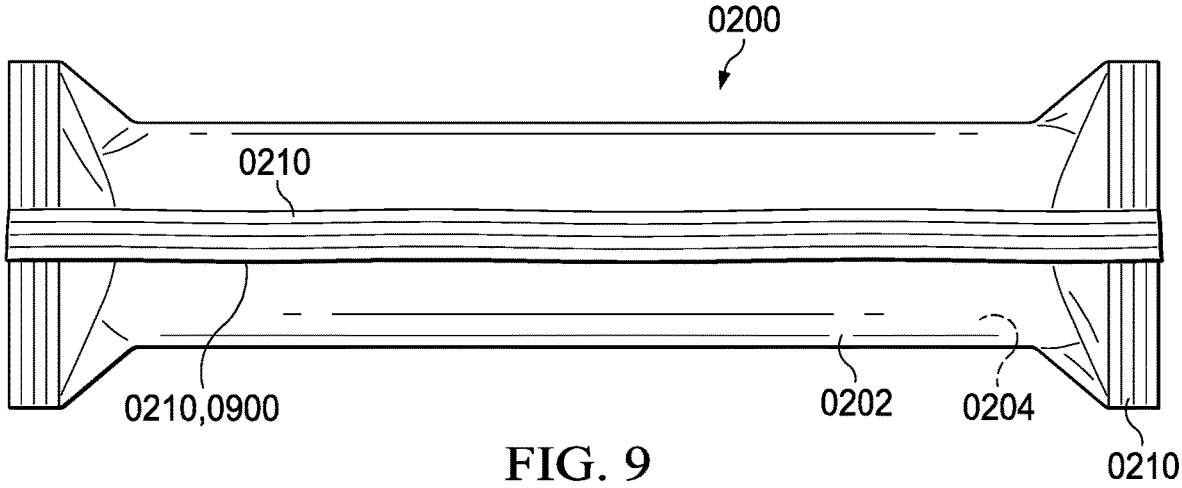
FIG. 9 is a schematic illustration of a resealable package with a longitudinal seal in the form of a fin seal.

In some embodiments, the product-facing surface 0204 of the package 0200 faces (e.g., and contacts) the product 0206. Additionally, in some embodiments, the product-facing surface 0204 of the package 0200 is located within a boundary formed by the at least one primary seal region 0104 (e.g. the first end seal region 0124, the second end seal region 0126, the first longitudinal seal region 0128, the second longitudinal seal region 0130, or a combination thereof). Furthermore, in some embodiments, the reseal region 0106 of the wrapper 0102 forms at least a portion of an inner surface of the package 0200;

With reference to FIG. 1, FIG. 9 and FIG. 16, in some embodiments of a method described herein, the method comprises forming 1606 a longitudinal seal 0900, adhering 1604 a first longitudinal seal region 0128 of the wrapper 0102 to a second longitudinal seal region 0130 of the wrapper 0102 (e.g., thereby forming 1606 a longitudinal seal 0900, or a combination thereof.

In some embodiments, the method comprises forming 1610 a first end seal 0214, adhering 1608 the first end seal region 0124 to itself (e.g., thereby forming 1610 a first end seal 0214), or a combination thereof.

In some embodiments, the method comprises forming 1614 a second end seal 0216, adhering 1612 the second end seal region 0126 to itself (e.g., thereby forming 1614 a second end seal 0216), or a combination thereof. Optionally, the second end 0118 of the wrapper 0102 can be opposite the first end 0116 of the wrapper 0102 and/or the second end seal 0216 can be opposite the first end seal 0214.

With reference to FIG. 2, FIG. 5, FIG. 15 and FIG. 17, illustrations are provided for a method for making 1700 an assembly 0500 comprising a product 0206 and an improved resealable package 0200 for the product 0206. As illustrated, the method comprises making 1500 a package 0200 according to a method described herein. Additionally, the step of forming 1505 the product containment space 0212 of the package 0200 comprises forming 1505 the product containment space 0212 around the product 0206.

Additional Embodiments

The following clauses are offered as further description of the disclosed invention:

1. An improved package precursor for an improved resealable package, wherein the precursor comprises:

a wrapper;

at least one primary seal region of the wrapper; and a reseal region of the wrapper;

wherein the reseal region is configured to adhere to itself when pressed against itself (e.g., by folding, twisting, etc.);

wherein the reseal region comprises a cold-seal-adhesive-coated region, which optionally is co-extensive with the reseal region (e.g., the reseal region can be the cold-seal-adhesive-coated region);

wherein the reseal region is configured to form at least a portion of a product containment surface of the package (e.g., at least 5, 10, 15, 20, 25, 30, 35, 40, 35, 50, 55, 60, 65, 70, 75, 80, 85, 90, 95, or 100% of the product containment surface of the package); and wherein the reseal region is configured to form at least a portion of a product-facing surface of the package (e.g., at least 5, 10, 15, 20, 25, 30, 35, 40, 35, 50, 55, 60, 65, 70, 75, 80, 85, 90, 95, or 100% of the product-facing surface of the package).

2. The precursor of clause 1, wherein the precursor comprises at least one feature selected from the group consisting of:

wherein the precursor is configured to provide a roll of the wrapper, optionally wherein the roll comprises a plurality of precursors according to the precursor of clause 1, optionally wherein the roll comprises a plurality of the at least one primary seal regions, optionally wherein the roll comprises a plurality of the reseal regions, optionally wherein the precursor is configured to be fed with the product (e.g. a plurality of product units) to a form, fill and seal machine and wherein the form, fill and seal machine forms the precursor into at least one package that contains the product (e.g., a plurality of packages, wherein each package comprises at least one of the product units or wherein each package comprises a plurality of the product units);

wherein the at least one primary seal region of the wrapper is configured to form at least one primary seal (e.g., a heat seal, ultrasonic weld, permanent seal, adhesive bond, non-resealable seal or combination thereof) for the package;

wherein the at least one primary seal does not comprise cold seal adhesive;

wherein the wrapper is configured to form a package for the product with specified barrier properties, wherein the specified barrier properties of the package are sufficient to satisfy a product quality test, wherein the product quality test comprises providing the product in the package with at least one initial product characteristic at an initial time, wherein the package is stored in air at 40° C. and 80% relative humidity from the initial time to a final time, wherein the final time is equal to the initial time plus 8 weeks, wherein the product has at least one final characteristic at the final time, wherein the at least one initial characteristic is selected from the group consisting of: a moisture concentration equal to 2.18 wt. %+/−10, 5, 4, 3, 2, 1, or 0%, a water activity equal to 0.17+/−10, 5, 4, 3, 2, 1, or 0%, a force required to break the product equal to 3.00 Kg-force +/−10, 5, 4, 3, 2, 1, or 0% (e.g., as measured using a texturometer), a color intensity of 3.91+/−10, 5, 4, 3, 2, 1, 0.5 or 0% wherein the color intensity is measured as the L coordinate of the color of the product as depicted in a CIEL*a*b* 1976 color space, and a combination thereof, wherein the at least one final characteristic is selected from the group consisting of: a moisture content equal to no more than 4.0, 3.5, 3.0, or 2.84 wt. %, a water activity equal to no more than 0.40, 0.35, 0.30, or 0.25, a force required to break the product equal to at least 2.40, 2.50, 2.60, 2.70, 3.00, or 3.07 Kg-force (e.g., as measured using a texturometer), a color intensity of 3.91%+/−10, 5, 4, 3, 2, 1, or 0% wherein the color intensity is equal to the L coordinate of the color of the product in the CIEL*a*b* 1976 color space as measured using a colorimeter, and a combination thereof;

wherein the package is configured so that the product stored in the package comprises an organoleptic profile with at least one characteristic that is at least equal to, equal to within +/−25, 20, 15, 10, 5, 4, 3, 2, or 1% of, equal to, or no more than at least one characteristic of a control package at the end of the specified time, wherein the package is equivalent to the control package, except that the package comprises cold seal adhesive on a reseal region located inside a primary seal region of the package wrapper and the control package does not comprise the cold seal adhesive, and wherein the at least one characteristic is a set of characteristics selected from one or a plurality of the characteristics listed in any one of FIGS. 18-24 or a combination of FIGS. 18-24;

wherein the wrapper is configured to form a package for the product with specified barrier properties, wherein the specified barrier properties of the package are sufficient to satisfy a product quality test, wherein the product quality test comprises providing the product in the package, wherein after storing the package for 10 weeks in air at 40° C. and 80% relative humidity, the product quality test (e.g., as conducted per latest editions as of Oct. 1, 2016, for official Mexican norms and/or the FDA's Bacteriological Analytical Manual) is satisfied if the product: has a total count of colony forming units per gram of product (CFU/g) equal to less than 5,000, 4,000, 3000, 2000, 1000, 500, 400, 300, 200, 100, 50, 40, or no more than 30 CFU/g, has a total coliforms count equal to less than 20, 15, 14, 13, 12, 11, or 10 CFU/g, has a mold count equal to less than 100, 90, 80, 70, 60, 50, 40, 30, 20 or no more than 10 CFU/g, has a yeast count equal to less than 100, 90, 80, 70, 60, 50, 40, 30, 20 or 10 CFU/g, tests negative for *salmonella* in 10 grams of the product, tests negative for *Escherichia Coli* in 10 grams of the product, or a combination thereof;

wherein the cold seal adhesive, any solvent in the cold seal adhesive, one face of the precursor including the wrapper but excluding any cold seal adhesive, one face of the precursor including the wrapper and cold seal adhesive, or a combination thereof, has an overall migration amount with respect to substances that can migrate from the precursor into the product, wherein the overall migration amount is equal to no more than 10 mg/dm^2 (i.e., milligrams per square decimeter) over 10 days at 40° C. as determined according to testing method DIN EN 1186, Part 15, overall migration test as of Aug. 8, 2016 (i.e., latest edition as of Aug. 8, 2016, for European Standard (EN) 1186, Part 15);

wherein the wrapper comprises a weight equal to 12.87 to 14.22 g/m^2 (i.e., grams per square meter) per ASTM D4321, Standard Test Methods for Package Yield of Plastic Film, latest edition as of Sep. 15, 2016;

wherein the wrapper comprises a nominal thickness equal to 14.25 to 15.75 microns per ASTM D374, Standard Test Methods for Thickness of Solid Electrical Insulation, latest edition as of Sep. 15, 2016, an average thickness equal to 14.25 to 15.75 microns, or a combination thereof;

wherein the wrapper comprises an optical density equal to at least 2.1 as measured by a Tobia Densitometer;

wherein the wrapper comprises a water vapor transmission rate (WVTR) equal to no more than 0.50, 0.45, 0.40, 0.38 grams/meter^2/24 hours, per ASTM F1249, latest edition as of Sep. 15, 2016, measured at a temperature of 38° C. and a relative humidity of 90%;

wherein the wrapper comprises an oxygen transmission rate (OTR) equal to no more than 28, 27, 26 or 25 cubic centimeters/m^2/day (e.g., cubic centimeters per square meter per day as measured per ASTM D1434-82 (2015) e1);

wherein the wrapper comprises a tensile strength in the machine direction equal to at least 105 N/25 mm^2 (i.e., 105 Newtons per 25 square millimeters) and/or a tensile strength in the transverse direction of at least 215 N/25 mm^2 as measured per ASTM D882, latest edition as of Sep. 15, 2016;

wherein the wrapper comprises a dimensional stability in the machine direction equal to at least −4.0% and/or a dimensional stability in the transverse direction of at least −3.0% as measured per ASTM D1204, latest edition as of Sep. 15, 2016, for a 25 cm by 25 cm area of the wrapper placed in an oven at 120° C. for 5 minutes;

wherein the wrapper comprises a coefficient of kinetic friction equal to 0.40 to 0.80 per ASTM D1894, latest edition as of Sep. 15, 2016;

wherein the wrapper comprises a seal strength equal to at least 6.0 N/25 mm^2 per ASTM F88, latest edition as of Sep. 15, 2016, measured for a seal formed by melting the wrapper to itself by using seal jaws at 115° C. to press two portions of the wrapper together under a pressure of 20 psi for 0.5 seconds;

wherein the wrapper comprises a minimum seal temperature equal to no more than 95° C. per ASTM F88 latest edition as of Sep. 15, 2016, determined as the minimum temperature required to provide a seal between two sheets of the wrapper after 0.5 seconds of sealing at 20 psi of seal jaw pressure for pressing the two sheets of the wrapper together;

wherein the primary seal has a maximum seal strength at least equal to a first specified maximum seal strength, no more than a second specified maximum seal strength, or a combination thereof, wherein the maximum seal strength, first specified maximum seal strength, the second specified maximum seal strength, or a combination thereof are selected from the group consisting of: 0.04, 0.1, 0.5, 3.7, 4.5, 0.04-4.5, 0.1-4.5, 0.5-4.5, 0.1-0.5 and 3.7-4.5 N/15 mm seal width when the seal is created by pressing two sheets of the wrapper between 2 corrugated jaws with one jaw heated to 110° C.; 1.5, 1.9, 2.5, 3.9, 4.2, 5.1, 1.5-5.1, 1.9-5.1, 2.5-5.1, 3.9-5.1 and 4.2-5.1 N/15 mm seal width when the seal is created by pressing two sheets of the wrapper between 2 corrugated jaws with one jaw heated to 120° C., 1.5, 1.9, 2.9, 3.3, 4.1, 4.2, 1.5-4.2, 1.9-4.2, 2.9-4.2, 3.3-4.2 and 4.1-4.2 N/15 mm seal width when the seal is created by pressing two sheets of the wrapper between 2 corrugated jaws with one jaw heated to 130° C.; 3.1, 3.2, 3.8, 3.9, 5.0, 3.1-5.0, 3.2-5.0, 3.8-5.0, 3.9-5.0 and 4.2-5.0 N/15 mm seal width when the seal is created by pressing two sheets of the wrapper between 2 corrugated jaws with one jaw heated to 140° C.; 3.6, 4.0, 4.1, 4.4, 4.6, 5.5, 3.6-5.5, 4.0-5.5, 4.1-5.5, 4.4-5.5 and 4.6-5.5 N/15 mm seal width when the seal is created by pressing two sheets of the wrapper between 2 corrugated jaws with one jaw heated to 150° C.; 3.6, 4.0, 4.7, 5.0, 5.6, 3.6-5.6, 4.0-5.6, 4.7-5.6 and 5.0-5.6 N/15 mm seal width when the seal is created by pressing two sheets of the wrapper between 2 corrugated jaws with one jaw heated to 160° C.; 3.4, 4.1, 4.7, 5.0, 3.4-5.0, 4.1-5.0 and 4.7-5.0 N/15 mm seal width when the seal is created by pressing two sheets of the wrapper between 2 corrugated jaws with one jaw heated to 110-170° C.; 2.5, 4.1, and 2.5-4.1 N/15 mm seal width when the seal is created by pressing two sheets of the wrapper between 2 corrugated jaws with one jaw heated to 110-170° C.; and 2.5, 5.6, and 2.5-5.6 N/15 mm seal width when the seal is created by pressing two sheets of the wrapper between 2 corrugated jaws with one jaw heated to 110-170° C.; wherein the maximum seal strength is measured after pressing the two sheets of the wrapper between the 2 corrugated jaws at 40 psi for a dwell time of 0.5 seconds and wherein the two corrugated jaws are brought together at a relative velocity of 30.5 cm/min, wherein the seal strength is measured by providing a discrete portion of the wrapper comprising two sheets of the wrapper, wherein the two sheets are sealed together to provide the seal while leaving an unsealed portion of each sheet, thereby providing a single interface that extends along the sealed and unsealed portions of both of the two sheets, wherein the interface between the sealed and unsealed portions is 15 mm wide thereby providing the 15 mm seal width, and pulling one of the unsealed portions of the wrapper in a direction opposite the other unsealed portion of the wrapper while the seal between the two sheets is supported (e.g., by hand) at 90 degrees to the pull direction, thereby causing a seal failure along the 15 mm seal width; and a combination thereof;

wherein the cold seal adhesive has an overall migration rate to a product in contact with the cold seal adhesive, wherein the cold seal adhesive is selected to minimize the overall migration rate of the cold seal adhesive to the product and/or to avoid or minimize effects on the product's organoleptic properties, for example, smell, taste, color and texture;

wherein the cold seal adhesive comprises a solvent, and wherein the solvent is selected to minimize the overall migration rate of the solvent to a product in contact with the cold seal adhesive and to avoid or minimize effects on the product's organoleptic properties, for example, smell, taste, color and texture;

wherein the cold seal adhesive provides a reseal closure that has a maximum seal strength of at least 0.56, 1.1, 2.2, 3.3, 4.4, 8.9, 13, 17, or 22 N/15 mm seal width (0.125, 0.25, 0.5, 0.75, 1, 2, 3, 4 or 5 lb-f/in. seal width), no more than 0.56, 1.1, 2.2, 3.3, 4.4, 8.9, 13, 17, or 22 N/15 mm seal width (0.125, 0.25, 0.5, 0.75, 1, 2, 3, 4 or 5 lb-f/in. seal width), or a combination thereof, wherein the maximum seal strength value is (i) the value provided when a continuous cold seal adhesive layer is adhered to another continuous cold seal adhesive layer, or (ii) the value provided when a first cold seal layer with a corresponding first configuration as applied to the wrapper is pressed against a second cold seal layer with a corresponding second configuration as applied to the wrapper, noting that the first and second configuration can be the same or different. Wherein the seal strength is measured by providing a discrete portion of the wrapper comprising two sheets of the wrapper, wherein each sheet is coated with cold seal adhesive either continuously or with the same configuration as used in the reseal closure, The seal strength can be measured by providing a discrete portion of the wrapper comprising two sheets of the wrapper that are each coated with cold seal adhesive and that are pressed together between two flat plates using 5 psi at 25° C. for 0.5 seconds to provide the seal while leaving an unsealed portion of each sheet, thereby providing an interface that extends along the sealed and unsealed portions of both of the two sheets, wherein the interface between the sealed and unsealed portions is 15 mm wide thereby providing the 15 mm seal width, and pulling one of the unsealed portions of the wrapper in a direction opposite the other unsealed portion of the wrapper while the seal between the two sheets is supported (e.g., by hand) at 90 degrees to the pull direction, thereby causing a seal failure along the 15 mm seal width;

wherein the cold seal adhesive comprises an additive to reduce or avoid a smell, taste or both associated with the cold seal adhesive;

wherein the cold seal adhesive comprises an additive to reduce or avoid transferring a smell, taste or both from the cold seal adhesive to the product;

wherein the at least one reseal region of the wrapper is configured to provide resealability for the package after opening at least one primary seal of the package, wherein the at least one primary seal of the package comprises the at least one primary seal region of the wrapper;

wherein the product containment surface and the at least one primary seal region are configured to provide a boundary for a product containment space within the package;

wherein the wrapper comprises a product containment region, wherein the product containment region is configured to provide the product containment surface of the package;

wherein the wrapper comprises a first end, a second end, a first edge, a second edge or a combination thereof;

wherein the at least one primary seal region comprises: a first end seal region, a second end seal region, a first longitudinal seal region, a second longitudinal seal region, or a combination thereof;

wherein the second end is opposite the first end;

wherein the second edge is opposite the first edge;

wherein the first end is adjacent to the first edge, the second edge or both the first edge and the second edge;

wherein the second end is adjacent to the first edge, the second edge or both the first edge and the second edge;

wherein the first edge is adjacent to the first end, the second end or both the first end and the second end;

wherein the second edge is adjacent to the first end, the second end or both the first end and the second end;

wherein the first end seal region is adjacent to the first end;

wherein the second end seal region is adjacent to the second end;

wherein the first longitudinal seal region is adjacent to the first edge;

wherein the second longitudinal seal region is adjacent to the second edge;

wherein the first end is separated from the second end by a minimum length of the wrapper;

wherein the first edge is separated from the second edge by a minimum width of the wrapper;

wherein the first end seal region is configured (e.g., positioned, oriented, made of materials, designed, or a combination thereof) to a provide a first end seal for the package;

wherein the second end seal region is configured to provide a second end seal for the package;

wherein the wrapper comprises a first longitudinal seal region and a second longitudinal seal region, wherein the first longitudinal seal region and the second longitudinal seal region are configured (e.g., positioned, oriented, made of materials, designed, or a combination thereof) to provide a longitudinal seal (e.g., lap seal, fin seal, etc.) for the package;

wherein cold seal adhesive is deposited on the cold-seal-adhesive-coated region of the wrapper (e.g., configured to provide the product-facing surface of the package, an inner surface of the package, or a combination thereof);

wherein the product-facing surface of the package is configured to face (e.g., and contact) the product;

wherein the product-facing surface of the package is located within a boundary formed by the at least one primary seal region (e.g. the first end seal region, the second end seal region, the first longitudinal seal region, the second longitudinal seal region, or a combination thereof);

wherein the at least one primary seal region of the wrapper comprises a thermoplastic;

wherein the at least one primary seal region of the wrapper (e.g., first end seal region, second end seal region, first longitudinal seal region, second longitudinal seal region, or a combination thereof) can be sealed using energy (e.g., heat, seal jaws, pressure, electromagnetic energy, ultrasonic waves, radiation, infrared radiation, light, or a combination thereof) to melt the wrapper in the at least one primary seal region so that the at least one primary seal region sticks to itself or a corresponding seal region (e.g., another seal region described herein) to form at least one primary seal;

wherein at least one primary seal region of the wrapper (e.g., first end seal region, second end seal region, first longitudinal seal region, second longitudinal seal region, or a combination thereof) can be sealed using an adhesive coating on the at least one primary seal region so that the at least one primary seal region sticks to itself or a corresponding seal region (e.g., another seal region described herein) to form at least one primary seal;

wherein the wrapper is shaped like a rectangle (e.g., square);

wherein the first end seal region, second end seal region, first longitudinal seal region, second longitudinal seal region, reseal region, cold-seal-adhesive-coated region, product-facing surface, product containment surface, or a combination thereof is shaped like a rectangle (e.g., square);

wherein the wrapper comprises film, polymer, plastic, thermoplastic, metal, paper, or a combination thereof;

wherein the wrapper comprises at least one characteristic selected from the following group of characteristics: bi-oriented film, polypropylene film, clear film, metallized film, aluminum-metallized film, at least two layers, 10-20 gauge film, 15 gauge film, or a combination thereof;

wherein the wrapper comprises a primary film layer, optionally wherein the primary film layer has a thickness of 10-20 gauge (e.g. 15 gauge), optionally wherein the primary film layer has a thickness of 10-30 micron, 10-20 micron (e.g. 15 micron), or 20-30 micron (e.g., 25 micron), optionally wherein the primary film layer is bi-axially oriented polypropylene, optionally wherein the primary film layer is clear, optionally wherein the primary film layer is reverse printed, optionally wherein a barrier layer is adhered (directly or indirectly) to the primary film layer, optionally allowing for at least one intermediate ink deposit, at least one color deposit, at least one adhesive deposit, at least one non-film layer, or a combination thereof between the primary film layer and barrier layer, optionally wherein the barrier layer comprises a barrier film layer, a metal layer, a metallized barrier film layer, or a combination thereof, optionally wherein the barrier layer, barrier film layer, metal layer, or metallized barrier film layer is configured to be on a product-facing surface 0204 of the wrapper that is adjacent to the product 0206, optionally wherein the primary film layer is configured to form a portion of the wrapper that is separated from the product 0206 by the barrier layer, optionally wherein the primary film layer is configured to be a print layer, optionally wherein the print layer (e.g., including any decoration, message, information, etc.) is configured to form a portion of the wrapper that is visible from an exterior of the wrapper, optionally wherein the barrier film layer is bi-axially oriented polypropylene, optionally wherein the barrier film layer is clear, optionally wherein the barrier film layer is metallized (e.g., with aluminum), optionally wherein the barrier film layer has a thickness of 10-20 gauge (e.g., 15 gauge), optionally wherein the barrier film layer has a thickness of 10-20 micron (e.g., 15 micron), optionally wherein the primary film layer is reverse printed on the surface of the primary film layer that is adjacent to the barrier layer, or a combination thereof; optionally wherein the at least one intermediary ink deposit, the at least one color deposit, the at least one adhesive deposit, or a combination thereof have a thickness of 0.5 to 4, 1-3 or 1.5 to 2.5 microns;

wherein an adhesive used in the at least one primary seal region (e.g., the first end seal region, second end seal region, first longitudinal seal region, second longitudinal seal region, or a combination thereof) is selected from the group consisting of: cold seal adhesive, non-resealable adhesive, permanent adhesive and a combination thereof;

wherein a cold seal adhesive applied to the cold-seal-adhesive-coated region is a water-based emulsion;

wherein the wrapper comprises layers and/or deposits selected from the group consisting of: a primary layer, an ink deposit (e.g., comprising any ink deposited (e.g., directly deposited) on the primary layer, which primary layer can be clear), an adhesive deposit (which can be deposited on the primary layer and any adhesive that has been deposited on the primary layer), a barrier layer, a print layer, a product facing layer (e.g., the barrier layer), and a combination thereof;

wherein the wrapper comprises a plurality of layers and/or deposits in the following order: a base layer, an ink deposit, an adhesive deposit, and a barrier layer;

wherein a cold seal adhesive is applied to the cold-seal-adhesive-coated region in a cold seal adhesive layer that is 1-5, 1-4, 2.5-3.5 or about 3 microns thick;

wherein a length reference line for the wrapper is a line from any first end point on the first end of the wrapper to any second endpoint on the second end wrapper;

wherein a minimum length reference line is the length reference line with the shortest length, and wherein a minimum length of the wrapper is the length of the minimum length reference line;

wherein the minimum length of the wrapper is at least 15, 20, 25, 26, 27, 28, 29 or 30 cm, no more than 15, 20, 25, 26, 27, 28, 29 or 30 cm, or a combination thereof;

wherein the maximum length of the wrapper is at least 30, 31, 32, 33, 34, 35, 40 or 60 cm, no more than 30, 31, 32, 33, 34, 35, 40 or 60 cm or a combination thereof;

wherein a maximum length of the product containment region in a direction parallel to the minimum length reference line is at least 1, 2, 3, 4, 5, 10, 15, 20, 25, 26, 27, 28, 29, or 29.5 cm, no more than 1, 2, 3, 4, 5, 10, 15, 20, 25, 26, 27, 28, 29, or 29.5 cm, or a combination thereof;

wherein a minimum length of the product containment region in a direction parallel to the minimum length reference line is at least 1, 2, 3, 4, 5, 10, 15, 20, 25, 26, 27, 28, 29, or 29.5 cm, no more than 1, 2, 3, 4, 5, 10, 15, 20, 25, 26, 27, 28, 29, or 29.5 cm, or a combination thereof;

wherein a width reference line is a line from any first edge point on the first edge of the wrapper to any second edge point on the second edge of the wrapper, wherein the width reference line is perpendicular to the minimum length reference line;

wherein a width of the wrapper at any reference point along the minimum length reference line is measured from the first edge of the wrapper to the second edge of the wrapper and along the width reference line passing through the reference point;

wherein a minimum width reference line is the width reference line with the shortest width, and wherein a minimum width of the wrapper is the width of the minimum width reference line;

wherein the minimum width of the wrapper is at least 10, 15, 16, 17, 18, 19 or 20 cm, no more than 10, 15, 16, 17, 18, 19 or 20, or a combination thereof;

wherein a maximum width of the product containment region in a direction parallel to the minimum width reference line is at least 1, 2, 3, 4, 5, 10, 11, 12, 13, 14, 15, 16, 17, 18, 19, or 19.5 cm, no more than 1, 2, 3, 4, 5, 10, 11, 12, 13, 14, 15, 16, 17, 18, 19, or 19.5 cm, or a combination thereof;

wherein a minimum width of the product containment region in a direction parallel to the minimum width reference line is at least 1, 2, 3, 4, 5, 10, 11, 12, 13, 14, 15, 16, 17, 18, 19, or 19.5 cm, no more than 1, 2, 3, 4, 5, 10, 11, 12, 13, 14, 15, 16, 17, 18, 19, or 19.5 cm, or a combination thereof;

wherein the precursor is compatible with existing (e.g., publicly known or not publicly known) product packaging lines (e.g., a form, fill an seal machine) for making the package in the sense that the addition of the reseal region (e.g., cold seal adhesive) does not require modifications of the process, does not require new equipment, only requires modifications that can be made without new equipment, or a combination thereof;

wherein the product is a perishable product (e.g., an edible product) or product intended for human consumption;

wherein the product is divided or divisible into multiple discrete portions (e.g., product units), all of which may not be consumed in a single use of the product (e.g., single serving of the product);

wherein the product has a characteristic selected from the following characteristics: the product is not so oily that reseal is prevented or is not oily in the sense that drops or pools of unabsorbed oil are present at the surface of the product 0206, the product does not comprise a filling that is exposed at the surface of the product (e.g., to an extent that reseal is prevented or to an extent that drops or pools of filling are present at the surface of the product 0206), the product does not comprise chocolate chips on a surface of the product (e.g., to an extent that reseal is prevented or does not comprise chocolate chips on the surface at all), the product comprises crumbles on a surface of the product and the crumbles cover no more than 5, 10, 15, 20, 30, 40, 50% of the surface of the product by area, the product comprises a powder on a surface of the product and the powder covers no more than 5, 10, 15, 20, 30, 40, 50% of the surface of the product by area, and a combination thereof;

wherein the package can remain safe for consumption or maintain desired organoleptic properties (e.g., one or any set of organoleptic properties described herein) for a shelf life of at least 36 weeks in air at 23° C. and 60% relative humidity;

wherein the package can remain safe for consumption or maintain desired organoleptic properties (e.g., one or any set of organoleptic properties described herein) for a shelf life of at least 36 weeks in air at 38° C. and 90% relative humidity;

wherein the wrapper, cold seal adhesive, precursor, package or combination thereof is safe for use with (e.g., safe for contact with) a consumable (e.g., edible) product or product intended for human consumption (e.g., as determined by a governmental agency responsible for permitting food, for example, the FDA in the United States or a corresponding authority in another country where the product will be sold or consumed);

wherein the wrapper, cold seal adhesive, precursor, package or combination thereof comprises no lead, no more than an undetectable amount of lead (e.g., no more than 10 mg/kg lead), no cadmium, no more than an undetectable amount of Cadmium (e.g., no more than 5 mg/kg Cadmium), no mercury, no more than an undetectable amount of mercury (e.g., no more than 1 mg/kg mercury), no Chromium, no more than an undetectable amount of Chromium (e.g., no more than 10 mg/kg Chromium), no Chromium IV, no more than an undetectable amount of Chromium IV (e.g., no more than 10 mg/kg of Chromium IV from compounds with Chromium in a +4 oxidation state), or a combination thereof; and a combination thereof.

3. An improved resealable package for a product; wherein the package comprises at least one feature selected from the group consisting of:

the precursor of any one of clauses 1 to 2;

the product-facing surface;

at least one primary seal; and the product containment surface;

wherein the wrapper is adhered to itself along the at least one primary seal region of the wrapper to provide the at least one primary seal of the package and a product containment space within the package;

wherein the product containment space within the package is bound by the product-facing surface of the package and the at least one primary seal of the package.

4. The package of clause 3, wherein the package comprises at least one feature selected from the group consisting of:

wherein the product-facing surface of the package comprises the reseal region of the wrapper, cold-seal-adhesive-coated region of the wrapper, cold seal adhesive, or a combination thereof;

wherein the first end seal region of the wrapper provides (e.g., is formed into, adhered to itself to provide, or a combination thereof) a first end seal for the package;

wherein the second end seal region of the wrapper provides (e.g., is formed into, adhered to itself to provide, or a combination thereof) a second end seal for the package;

wherein the first longitudinal seal region and the second longitudinal seal region of the wrapper are joined (e.g., mutually adhered) to provide a longitudinal seal for the package;

wherein the package is safe for use with (e.g., safe for contact with) a consumable (e.g., edible) product or product intended for human consumption (e.g., as determined by a governmental agency responsible for permitting food, for example, the FDA in the United States or a corresponding authority in another country where the product will be sold or consumed); and a combination thereof 5. An assembly comprising the package of any of clauses 3 to 4 and a product contained by the package.

6. The assembly of clause 5, wherein the assembly comprises at least one feature selected from the group consisting of:

wherein the product is crumbly;

wherein the product is powdery;

wherein the cold seal adhesive is effective to provide a seal upon being pressed against itself if up to 10, 20, 30, 40, 50, 60 or 70% of the surface area of the cold seal adhesive on the reseal region of the wrapper if covered with particles (e.g., crumbs, powder, etc.) of the product; and a combination thereof.

7. A method for making an improved package precursor for an improved resealable package, the method comprising:

providing a wrapper comprising at least one primary seal region and a reseal region;

depositing a cold seal adhesive on the reseal region to provide a cold-seal-adhesive-coated region of the wrapper;

wherein the reseal region is configured to form at least a portion of a product containment surface of the package; and wherein the reseal region is configured to form at least a portion of a product-facing surface of the package.

8. The method of clause 7, wherein the method comprises at least one feature selected from the group consisting of:

wherein the precursor is the precursor of any one of clause 1 to 2;

wherein the package is the package of any one of clauses 3 to 4; and a combination thereof.

9. A method for making an improved resealable package, the method comprising:

making a precursor according to the method of any one of clauses 7 to 8;

adhering at least one primary seal region of the wrapper to itself (e.g., first end seal region or second end seal region) or adhering a first seal region (e.g., the first longitudinal seal region) in the at least one primary seal region to a second seal region (e.g., the second longitudinal seal region) in the at least one primary seal region, or a combination thereof, thereby forming at least one primary seal of the package and forming a product containment space of the package;

wherein the product containment space is bound by the at least one primary seal and the product containment surface of the package;

wherein the product containment surface of the package comprises at least a portion of the reseal region (e.g., at least 5, 10, 15, 20, 25, 30, 35, 40, 35, 50, 55, 60, 65, 70, 75, 80, 85, 90, 95, or 100% of the reseal region); and wherein the reseal region of the wrapper forms at least a portion of the product-facing surface of the package.

10. The method of any one of clauses 7 to 9, wherein the method comprises at least one feature selected from the group of features consisting of:

wherein the product containment space contains a product;

forming the product containment space by wrapping the wrapper around the product and sealing the wrapper to form the at least one primary seal;

wherein the product-facing surface of the package faces (e.g., and contacts) the product;

wherein the product-facing surface of the package is located within a boundary formed by the at least one primary seal region (e.g. the first end seal region, the second end seal region, the first longitudinal seal region, the second longitudinal seal region, or a combination thereof);

wherein the reseal region of the wrapper forms at least a portion of an inner surface of the package;

wherein the method comprises adhering a first longitudinal seal region of the wrapper to a second longitudinal seal region of the wrapper (e.g., thereby forming a longitudinal seal), wherein the method comprises adhering a first end seal region to itself (e.g., thereby forming a first end seal);

wherein the method comprises forming a second end seal by adhering a second end seal region to itself, wherein the second end of the wrapper is opposite the first end of the wrapper and/or the second end seal region of the wrapper is opposite the first end seal region of the wrapper;

wherein the method comprises opening at least one primary seal (e.g., breaking, rupturing, or permanently opening the at least one primary seal, or a combination thereof);

wherein the method comprises resealing the package by adhering a first portion of the reseal region to a second portion of the reseal region (e.g., by pressing the first portion of the reseal region against the second portion of the reseal region, for example, by folding or twisting the reseal region, by using the cold seal adhesive, or a combination thereof), thereby forming a reseal closure;

wherein the method comprises resealing the package by adhering a first portion of the reseal region to a second portion of the reseal region thereby forming a reseal closure, reopening the package by opening the reseal closure, optionally, wherein the method comprises repeating the resealing and reopening a plurality of times, optionally, wherein, for a subsequent resealing step or for each subsequent resealing step, a first portion of the reseal region, a second portion of the reseal region, or a combination thereof, as adhered to form a subsequent reseal closure, includes a portion of the reseal region that was not used to form a previous reseal closure, optionally, wherein the plurality of times is equal to the number of servings listed on a label of the package minus 1, optionally wherein the plurality of times is equal to at least 2, 3, 4, 5, 6, 7, 8, 9, or 10 times, optionally wherein the reseal closure is sufficiently sealed so that a package resealed using the reseal closure has no visibly apparent openings in the package; optionally wherein the reseal closure is sufficiently sealed so that a package resealed using the reseal closure has no openings with a size greater than 1, 0.9, 0.8, 0.7, 0.6, 0.5, 0.4, 0.3, 0.2, 0.1, 0.05, 0.04, 0.03, 0.02 or 0.01 mm, wherein the size is measured as the longest distance between any two points on a perimeter of the opening;

wherein the method for making the improved resealable package comprises: feeding the precursor comprising the wrapper to a form, fill and seal machine at a linear rate of at least 20, 30, 35, 38, 40, 45, 50, 55 m/min, no more than 30, 35, 38, 40, 45, 50, 55, or 60 m/min, or a combination thereof; using the form, fill and seal machine to form the wrapper into a package around the product; and discharging discrete packages containing the product at a linear rate of at least 20, 30, 35, 38, 40, 45, 50, 55 m/min, no more than 30, 35, 38, 40, 45, 50, 55, or 60 m/min, or a combination thereof;

wherein the method for making the improved resealable package comprises: feeding the precursor comprising the wrapper to an existing form, fill and seal machine configured to form a package from a reference precursor, wherein the reference precursor is equivalent to the improved precursor except that the reference precursor does not comprise the reseal region, optionally, wherein the existing form, fill and seal machine requires no additional equipment between being used to form packages from the reference precursor and the precursor, optionally, wherein controllable settings of the existing form, fill and seal machine are not modified by more than 20, 15, 10, 9, 8, 7, 6, 5, 4, 3, 2 or 1% of the controllable settings used to form a package for the reference precursor between the time the machine is used to form packages from the reference precursor and the time the machine is used to form packages from the improved precursor, optionally wherein the form, fill and seal machine is unmodified between being used to form packages from the reference precursor and being used to form packages from the improved precursor, optionally wherein the reference precursor is equivalent to the improved precursor in the sense that a value associated with a precursor characteristic differs from a value associated with the corresponding reference precursor characteristic by no more than 20, 15, 10, 9, 8, 7, 6, 5, 4, 3, 2 or 1% of the reference precursor characteristic, optionally wherein the reference precursor characteristic is selected from length, width, surface area, average thickness, mass, composition or a combination thereof; and a combination thereof.

11. A method for making an assembly comprising a product and an improved resealable package for the product, the method comprising:

making a package according to the method of any one of clauses 9 to 10;

wherein the forming the product containment space of the package comprises forming the product containment space around the product.

12. The method of clause 11, wherein the method comprises at least one feature selected from the group consisting of:

wherein the precursor is the precursor of any one of clauses 1 to 2;

wherein the package is the package of any one of clauses 3 to 4;

wherein the assembly is the assembly of any one of clauses 5 and 6; and a combination thereof.

13. An improved package precursor, resealable package, or assembly made according to the method of any one of clauses 7-12.

Although the present disclosure has provided many examples of systems, apparatuses, package precursors, packages, assemblies and methods, it should be understood that the components of the systems, apparatuses, package precursors, packages, assemblies and methods described herein are compatible and additional embodiments can be created by combining one or more elements from the various embodiments described herein. As an example, in some embodiments, a method described herein can further comprise one or more elements of a system described herein or a selected combination of elements from any combination of the systems or apparatuses described herein.

Furthermore, in some embodiments, a method described herein can further comprise using a system described herein, using one or more elements of a system described herein, using a selected combination of elements from any combination of the systems described herein, or making a package precursor, a package, or an assembly as described herein.

Although embodiments of the invention have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. Accordingly, it should be understood that the method steps described herein are exemplary, and upon reading the present disclosure, a skilled person would understand that one or more method steps described herein can be combined, omitted, re-ordered, or substituted.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

Where language, for example, "for" or "to", is used herein in conjunction with an effect, function, use or purpose, an additional embodiment can be provided by substituting "for" or "to" with "configured for/to", "adapted for/to", "configured to provide", or "adapted to provide".

Additionally, when a range for a particular variable is given for an embodiment, an additional embodiment can be created using a subrange or individual values that are contained within the range. Moreover, when a value, values, a range, or ranges for a particular variable are given for one or more embodiments, an additional embodiment can be created by forming a new range whose endpoints are selected from any expressly listed value, any value between expressly listed values, and any value contained in a listed range. For example, if the application were to disclose an embodiment in which a variable is 1 and a second embodiment in which the variable is 3-5, a third embodiment can be created in which the variable is 1.31-4.23. Similarly, a fourth embodiment can be created in which the variable is 1-5.

As used herein, examples of "substantially" include: "more so than not," "mostly," and "at least 30, 40, 50, 60, 70, 80, 90, 95, 96, 97, 98 or 99%" with respect to a referenced characteristic. With respect to vectors, directions, movements or angles, that are "substantially" in the same direction as or parallel to a reference vector, direction, movement, angle or plane, "substantially" can also mean "at least a component of the vector, direction, movement or angle specified is parallel to the reference vector, direction, movement, angle or plane," although substantially can also mean within plus or minus 45, 40, 35, 30, 25, 20, 15, 10, 5, 4, 3, 2, or 1 degrees of the reference vector, direction, movement, angle or plane.

As used herein, examples of "about" and "approximately" include a specified value or characteristic to within plus or minus 30, 25, 20, 15, 10, 5, 4, 3, 2, or 1% of the specified value or characteristic.

When an embodiment is described as characterized by a value being no more than a specific amount, additional embodiments can be created in which the value ranges from the minimum possible value to the specific amount, from 0 to the specific amount, from greater than 0 to the specific amount, from 0.1 times the specific amount to the specific amount, from 0.2 times the specific amount to the specific amount, from 0.3 times the specific amount to the specific amount, from 0.4 times the specific amount to the specific amount, from 0.5 times the specific amount to the specific amount, from 0.6 times the specific amount to the specific amount, from 0.7 times the specific amount to the specific amount, from 0.8 times the specific amount to the specific amount, from 0.9 times the specific amount to the specific amount or a combination thereof.

When an embodiment is described as characterized by a value being at least a specific amount or no less than a specific amount, additional embodiments can be created in which the value ranges from the specific amount to the maximum possible value, from the specific amount to 100 times the specific amount, from the specific amount to 10 times the specific amount, from the specific amount to 9, 8, 7, 6, 5, 4, 3, 2, 1.9, 1.8, 1.7, 1.6, 1.5, 1.4, 1.3, 1.2, or 1.1 times the specific amount, or a combination thereof.

While this invention has been particularly shown and described with reference to preferred embodiments, it will be understood by those skilled in the art that various changes in form and detail may be made therein without departing from the spirit and scope of the invention. The inventor expects skilled artisans to employ such variations as appropriate, and the inventor intends the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. An improved package precursor for an improved resealable package, wherein the precursor comprises:

a wrapper;

at least one primary seal region of the wrapper;

a reseal region of the wrapper; and cold seal adhesive;

wherein the wrapper comprises a product containment region for a product in the package, wherein the product containment region is configured to be at least a portion of a product containment surface of the package;

wherein the product containment surface of the package consists of all portions of the package configured to contain and potentially contact the product in the package while the package is initially unopened;

wherein the at least one primary seal region of the wrapper is configured to form at least one primary seal of the package;

wherein the reseal region is configured to adhere to itself when pressed against itself;

wherein the reseal region comprises a cold-seal-adhesive-coated region, wherein the cold-seal-adhesive-coated region is coated with the cold seal adhesive;

wherein the precursor is configured so that the cold seal adhesive that coats the reseal region forms (i) at least a portion of the product containment region of the wrapper, (ii) at least a portion of the product containment surface of the package while the package is initially unopened, and (iii) at least a portion of a product-facing surface of the package while the package is initially unopened.

2. The precursor of claim 1, wherein the precursor is configured to provide a roll of the wrapper, and wherein the roll comprises a plurality of precursors according to the precursor of claim 1.

3. The precursor of claim 1, wherein the at least one primary seal does not comprise cold seal adhesive.

4. The precursor of claim 1, wherein the cold seal adhesive, any solvent in the cold seal adhesive, one face of the precursor including the wrapper and the cold seal adhesive, or a combination thereof has an overall migration amount with respect to substances that can migrate from the precursor into the product, wherein the overall migration amount is equal to no more than 10 $mg/dm^2$ over 10 days at 40° C. as determined according to testing method DIN EN 1186, Part 15, overall migration test, latest edition as of Aug. 8, 2016.

5. The precursor of claim 1, wherein the wrapper comprises a water vapor transmission rate (WVTR) equal to no more than 0.50 $g/m^2/24$ hours, per ASTM F1249, latest edition as of Sep. 15, 2016, measured at a temperature of 38° C. and a relative humidity of 90%.

6. The precursor of claim 1, wherein the wrapper comprises an oxygen transmission rate (OTR) equal to no more than 28 cubic $cm/m^2/day$ as measured per ASTM D1434-82 (2015) e1.

7. The precursor of claim 1, wherein the cold seal adhesive provides a reseal closure that has a maximum seal strength value of at least 0.56 N/15 mm seal width and no more than 22 N/15 mm seal width, wherein the maximum seal strength value is the maximum seal strength value provided when a first cold seal layer with a corresponding first configuration as applied to the wrapper is pressed against a second cold seal layer with a corresponding second configuration as applied to the wrapper.

8. The precursor of claim 1, wherein the cold seal adhesive comprises an additive to reduce a smell, taste or both associated with the cold seal adhesive or wherein the cold seal adhesive comprises an additive to reduce or avoid transferring a smell, taste or both from the cold seal adhesive to the product.

9. The precursor of claim 1, wherein the reseal region of the wrapper is configured to provide resealability for the package after opening the at least one primary seal of the package, wherein the at least one primary seal of the package comprises the at least one primary seal region of the wrapper.

10. The precursor of claim 1, wherein the product containment surface comprises (i) a portion of an adhesive that coats the at least one primary seal region or (ii) a portion of the at least one primary seal region that is configured to contain and potentially contact the product in the package; and wherein the product containment surface is configured to provide a boundary for a product containment space within the package.

11. The precursor of claim 1, wherein the wrapper comprises: a first end, a second end opposite the first end, a first edge adjacent to the first end and the second end, and a second edge opposite the first edge and adjacent to the first end and the second end;

wherein the at least one primary seal region comprises: a first end seal region adjacent to the first end, a second end seal region adjacent to the second end, a first longitudinal seal region adjacent to the first edge, and a second longitudinal seal region adjacent to the second edge;

wherein the first end seal region is configured to a provide a first end seal for the package;

wherein the second end seal region is configured to provide a second end seal for the package; and wherein the first longitudinal seal region and the second longitudinal seal region are configured to provide a longitudinal seal for the package.

12. The precursor of claim 1, wherein the at least one primary seal region of the wrapper comprises a thermoplastic; and wherein the at least one primary seal region of the wrapper can be sealed using heat to melt the wrapper in the at least one primary seal region to form the at least one primary seal.

13. The precursor of claim 1, wherein the cold seal adhesive applied to the cold-seal-adhesive-coated region is a water-based emulsion.

14. The precursor of claim 1, wherein the wrapper, the cold seal adhesive, the precursor, the package or combination thereof is safe for contact with a product intended for human consumption.

15. The precursor of claim 1, wherein the cold-seal-adhesive-coated region is coextensive with the reseal region.

16. The precursor of claim 1:

wherein the product-facing surface of the package is configured to be a product-contacting surface of the package; and wherein the precursor is configured so that the product can potentially contact the product-contacting surface when the package is initially unopened.

17. The precursor of claim 1: wherein the product containment surface comprises (i) a portion of an adhesive that coats the at least one primary seal region and is configured to contain and potentially contact the product in the package or (ii) a portion of the at least one primary seal region that is configured to contain and potentially contact the product in the package.

18. An improved resealable package; wherein the package comprises:

a precursor;

a product-facing surface of the package;

at least one primary seal of the package; and a product containment surface of the package;

wherein the precursor comprises:

a wrapper;

at least one primary seal region of the wrapper;

a reseal region of the wrapper; and cold seal adhesive;

wherein the wrapper comprises a product containment region for a product in the package, wherein the product containment region is configured to be at least a portion of the product containment surface of the package;

wherein the product containment surface of the package consists of all portions of the package configured to contain and potentially contact the product in the package while the package is initially unopened;

wherein the at least one primary seal region of the wrapper is configured to form the at least one primary seal of the package;

wherein the reseal region is configured to adhere to itself when pressed against itself;

wherein the reseal region comprises a cold-seal-adhesive-coated region, wherein the cold-seal-adhesive-coated region is coated with the cold seal adhesive;

wherein the precursor is configured so that the cold seal adhesive that coats the reseal region forms (i) at least a portion of the product containment region of the wrapper, (ii) at least a portion of the product containment surface of the package while the package is initially unopened, and (iii) at least a portion of the product-facing surface of the package while the package is initially unopened;

wherein the wrapper is adhered to itself along the at least one primary seal region of the wrapper to provide the at least one primary seal of the package and a product containment space within the package;

wherein the product containment space within the package is bounded by the product-facing surface of the package, the product-facing surface of the package comprising any portion of at least one primary seal of the package that is configured to contain and potentially contact the product in the package.

19. An assembly comprising the package of claim 18 and the product contained by the package.

20. The improved resealable package of claim 18, wherein the package is configured so that, while the package is initially unopened, an entire boundary of the product containment space consists of the product containment surface of the package, the product containment surface comprising (i) a portion of an adhesive that coats the at least one primary seal of the package and is configured to contain and potentially contact the product in the package or (ii) a portion of the at least one primary seal region that is configured to contain and potentially contact the product in the package.

21. An assembly comprising the package of claim 20 and the product contained within the product containment space of the package.

* * * * *